US006532766B1

(12) United States Patent
Chia et al.

(10) Patent No.: US 6,532,766 B1
(45) Date of Patent: Mar. 18, 2003

(54) DECORATIVE JEWELRY ITEM

(76) Inventors: Meang K. Chia, 412 W. 6th St. Suite 1104, Los Angeles, CA (US) 90014; Cheo K. Chia, 412 W. 6th St. Suite 1104, Los Angeles, CA (US) 90014; Huy K. Chia, 412 W. 6th St. Suite 1104, Los Angeles, CA (US) 90014

( * ) Notice: Subject to any disclaimer, the term of this patent is extended or adjusted under 35 U.S.C. 154(b) by 0 days.

(21) Appl. No.: 09/383,814

(22) Filed: Aug. 26, 1999

(51) Int. Cl.[7] ..... A44C 17/02
(52) U.S. Cl. ..... 63/26; 63/29.1
(58) Field of Search ..... 63/26, 29.1

(56) References Cited

U.S. PATENT DOCUMENTS

| | | | |
|---|---|---|---|
| D12,579 | S | 11/1881 | Reynolds |
| D14,818 | S | 2/1884 | Merril |
| 439,139 | A | 10/1890 | Gaynor |
| 569,495 | A | 10/1896 | Gunther |
| 572,237 | A | 12/1896 | Adams |
| D32,439 | S | 4/1900 | Gay |

(List continued on next page.)

FOREIGN PATENT DOCUMENTS

| | | |
|---|---|---|
| CH | 238894 | 8/1945 |
| EP | 0 063 751 A1 | 11/1982 |
| FR | 608150 | 7/1926 |
| FR | 709603 | 8/1931 |
| FR | 1 319 354 | 5/1963 |
| GB | 1 077 460 | 7/1967 |
| GB | 1 200 257 | 7/1970 |
| GB | 2 070 344 A | 9/1981 |
| GB | 2 077 441 A | 12/1981 |
| WO | 00/38551 | 7/2000 |

OTHER PUBLICATIONS

"Charms" catalog, p. 136, Item #136–20, by Americas GOLD, 650 South Hill St., Los Angeles, CA 90014.
"Liberty Collections" catalog, pp. 4 and 21, by Liberty I. Exchange, 333 Washington St., #203–1, Boston, MA 02108.
"Diamond Flower" jewelry by S & R Designs, Inc., Marlton NJ.
Items #P10529, #84622, National Jeweler, May 16, 1997.
Janet Alix necklace, Jewelers' Circular Keystone, May 1997.

(List continued on next page.)

*Primary Examiner*—J. J. Swann
*Assistant Examiner*—Andrea Chop
(74) *Attorney, Agent, or Firm*—Ladas & Parry

(57) ABSTRACT

A decorative jewelry item comprises a base member with a hollow interior and a decorative top, a cap brought down over the decorative top, and a fastener arrangement for fixing the cap to the base member after the cap is brought into contact with the decorative top. The cap has an opening therein through which the decorative top of the base member can be observed. All exposed surfaces of the base member and cap may have surface finishing features and/or graphic representations or designs to make the jewelry item more attractive. The jewelry item may be designed to have the appearance of a single decorative unit, or to have the appearance of a double (or greater) decorative unit. Such units have application in many jewelry items. A number of such units may be connected in series to form a tennis bracelet.

82 Claims, 13 Drawing Sheets

U.S. PATENT DOCUMENTS

D32,649 S 5/1900 McCutchen et al.
795,109 A 7/1905 Dover
813,084 A 2/1906 Dover
851,078 A 4/1907 Dunn
1,001,583 A 8/1911 Fairbrother
1,024,048 A 4/1912 Abel
D42,514 S 5/1912 Meyers
D42,643 S 6/1912 Meyers
1,153,362 A 9/1915 Wacha
D48,950 S 4/1916 Rosenberger
1,189,497 A 7/1916 Schwartzman
1,344,365 A 6/1920 Wachenheimer
D55,597 S 7/1920 Felger
D56,605 S 11/1920 Grasmuk
D56,607 S 11/1920 Grasmuk
1,410,366 A 3/1922 Buchman
1,433,521 A 10/1922 Albanese
1,443,654 A 1/1923 Schmidt
1,467,468 A 9/1923 Blanchard
1,556,465 A 10/1925 Wendel
1,570,776 A * 1/1926 Peters ..... 63/29.1
1,570,932 A 1/1926 Anderson et al.
1,589,423 A 6/1926 Payton
D76,664 S 10/1928 Chase
D77,434 S 1/1929 Rice
1,701,610 A 2/1929 Forstner
1,710,660 A 4/1929 Guyot
D84,213 S 3/1931 Speidel
1,842,427 A 1/1932 Sammartino
1,854,958 A 4/1932 Santosuosso
1,892,738 A * 1/1933 Schnarr ..... 63/15
1,981,696 A 11/1934 Harper
D110,568 S 5/1938 Garfinkel
D117,577 S 8/1939 Sand
D119,286 S 3/1940 Somers
D131,847 S 2/1942 Hobe
2,273,227 A 2/1942 Simmons
D131,750 S 3/1942 Hobe
D143,583 S 1/1946 Feingold
D143,588 S 1/1946 Grun
D143,750 S 2/1946 Philippe
D145,426 S 2/1946 Braunstein
D144,901 S 6/1946 Braunstein
D146,779 S 5/1947 Slater
D151,904 S 8/1948 Katz
D155,873 S 11/1949 Chernow
D156,650 S 12/1949 Pearce et al.
D156,744 S 1/1950 Kent
D159,528 S 8/1950 Philippe
D159,582 S 8/1950 Boucher
D160,241 S 9/1950 Bardach
2,526,134 A 10/1950 Henry
2,538,090 A 1/1951 Ferragamo
D165,468 S 12/1951 Katz
2,584,207 A 2/1952 Holl
2,634,593 A 4/1953 Moretti
D176,664 S 1/1956 Katz
2,852,923 A 9/1958 Gamelsky
D184,930 S 4/1959 Gonicberg
D186,903 S 12/1959 Hess
3,025,820 A 3/1962 Rosenthal
D202,723 S 11/1965 Gaston
3,483,716 A * 12/1969 Stenzler ..... 63/15
3,670,524 A 6/1972 Korwin
4,154,282 A 5/1979 Kull
4,165,574 A 8/1979 Sciotti
D257,017 S 9/1980 Barr
D265,639 S 8/1982 Barr
D266,954 S 11/1982 Gordan
4,399,910 A 8/1983 Gutentag
4,488,415 A * 12/1984 Jenkins ..... 63/29.1
D277,466 S 2/1985 Chien
4,551,993 A 11/1985 Nagahori
4,566,294 A 1/1986 Brzozowski
4,763,489 A 8/1988 Strong
4,781,038 A 11/1988 Branca et al.
D314,528 S 2/1991 Chia et al. ..... D11/93
D314,730 S 2/1991 Chia et al. ..... D11/93
D314,929 S 2/1991 Chia et al. ..... D11/6
D317,139 S 5/1991 Chia et al. ..... D11/93
D317,423 S 6/1991 Chia et al. ..... D11/93
D319,033 S 8/1991 Chia et al. ..... D11/93
5,056,337 A 10/1991 Nhaissi
D322,043 S 12/1991 Chia et al. ..... D11/93
D325,180 S 4/1992 Chia et al. ..... D11/93
D325,709 S 4/1992 Chia et al. ..... D11/93
D325,710 S 4/1992 Chia et al. ..... D11/93
D325,711 S 4/1992 Chia et al. ..... D11/93
D325,886 S 5/1992 Chia et al. ..... D11/93
D329,026 S 9/1992 Chia et al. ..... D11/93
D329,206 S 9/1992 Chia et al. ..... D11/93
D329,401 S 9/1992 Chia et al. ..... D11/93
D331,726 S 12/1992 Chia et al. ..... D11/93
D335,639 S 5/1993 Chia et al. ..... D11/93
D336,057 S 6/1993 Chia et al. ..... D11/93
D336,059 S 6/1993 Chia et al. ..... D11/93
D336,060 S 6/1993 Chia et al. ..... D11/93
D337,069 S 7/1993 Chia et al. ..... D11/93
D337,070 S 7/1993 Chia et al. ..... D11/93
D337,283 S 7/1993 Keshishian
D337,546 S 7/1993 Keshishian
D337,547 S 7/1993 Keshishian
D338,852 S 8/1993 Keshishian
5,355,698 A 10/1994 Edmark
5,365,754 A 11/1994 Nalbandian
D379,074 S 5/1997 Udko
D388,016 S 12/1997 Kejejian
5,694,791 A 12/1997 Esposito
5,806,345 A * 9/1998 Bonchek ..... 63/15.1
D406,247 S 3/1999 Chia et al. ..... D11/93
5,992,177 A * 11/1999 Beard ..... 63/29.1
D418,445 S 1/2000 Chia et al. ..... D11/93
D418,446 S 1/2000 Chia et al. ..... D11/93
D423,981 S 5/2000 Chia et al. ..... D11/93
6,116,054 A * 9/2000 Czupor ..... 63/26

OTHER PUBLICATIONS

Catalog Item #4D, Skalet Gold, 3600 N. Talman Ave., Chicago, IL 60618.

Caroline Ballou Collection, June Las Vegas Show, K25–K27, and Barnett Robinson, Inc., June Las Vegas Show, Galleria #10.

Item N362, P.Q.C. Jewelry, National Jeweler, Jun. 1, 1998, p. 142.

"Love Tears" collection, by Studs, Inc., 42 West 48th Street, New York, NY 10036.

Slide Pendent, by Superior Diamond Cutters Inc., 589 Fifth Ave., New York, NY 10017.

Uni–Creation Inc., Emby International Inc. collection, 589 Fifth Ave., New York, NY 10017.

A Promotional Supplement to JCK, May 1997, pp. 178–179.

Item SS424, Corona Jewelry Company, 16 Ripley Ave., Toronto, Ontario, M6S 3N9, Canada.

"Bezel–set Jewelry," California Gold Center, 606 South Hill Street, Los Angeles, CA 90014.

"Partners" fashion jewelry, Cache fashion watches, Mervyn's California catalog flyer, 1998, p. 11.

Crafford Precision Products Co. Catalog "Laser Spot–Welding Systems," One Industrial Court, Riverside, RI 02915.
Maty, Collection Automne—Hiver 97–98, Valeur 30F, No. 76.
*Robinson's May*, Item No. 290131409, Purchased Apr. 18, 1999.
*A&A Jewelry Tools & Findings Catalog*, p. G92.
*The Gold Book*, Item Nos. HE.142(A) 2.37gr. (89), HE.141 (A) 2.37gr. (89), HE.143 (A) 2.89gr. (108), p. 18 (1996).
*Fancy Catalog*, Item Nos. 11111, 11112, 11114, p. 111.
The Multi–Color Gold Jewelry Book, Oro America, p. 1, Earring Items; ETR.014; ETR.022; ETLB.001.
Jaha Jewelry, Inc., Item Nos. J2–1, J3–15, J6–9, J6–13, J6–16, J10–1, J10–2, J13–19 (640 S. Hill St., #748, Los Angeles, CA 90014).
"Rio Grande: Gems & Findings", Gold earrings: 14K yellow back–set French wire earrings Die Struck, Item "M", p. 90.
*All Karats International*; Edizioni, Primavera–Estate/Spring–Summer, Sixth Edition; "Diamond Necklace "; 2 pages including cover (1998).
Variety Gem Co., Inc.; *JCK Catalog* 05–97; Items N5526, N5520A, N5520B; one page (May 1997).
Wards, Gold Hoop (Earring) with Diamond Cut Ovals, Item #459312000; 4 pages.

* cited by examiner

FIG. 1
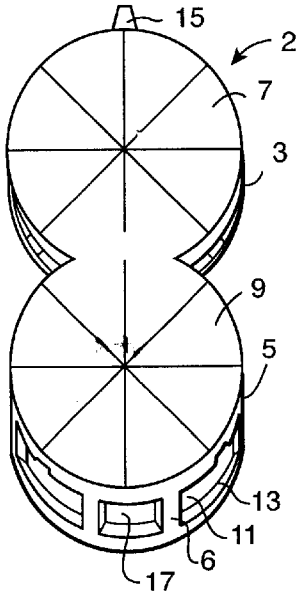
FIG. 4
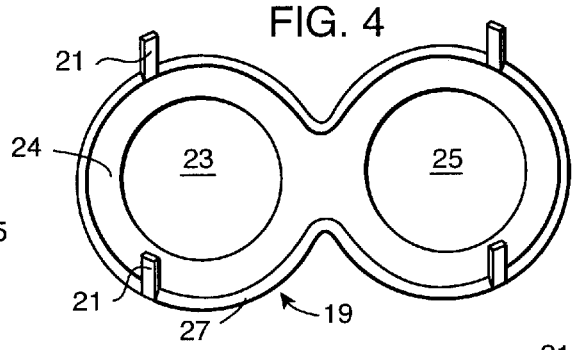
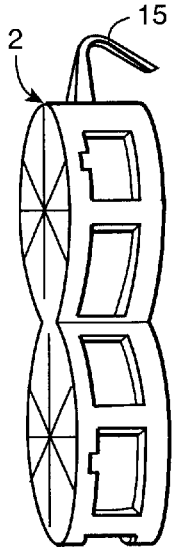
FIG. 3
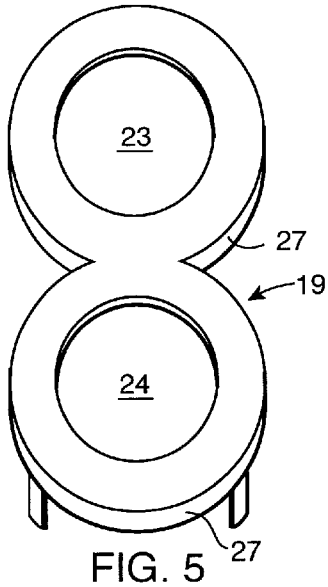
FIG. 5
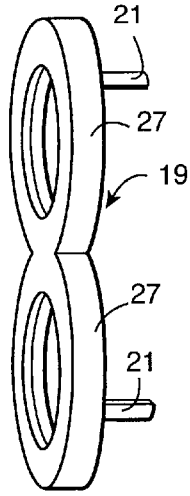
FIG. 6
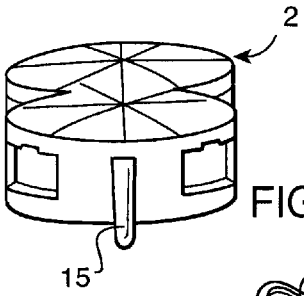
FIG. 2
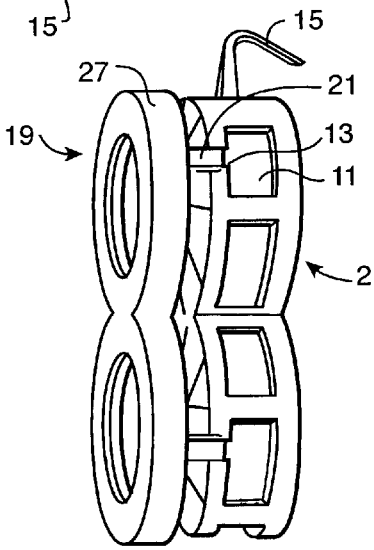
FIG. 7
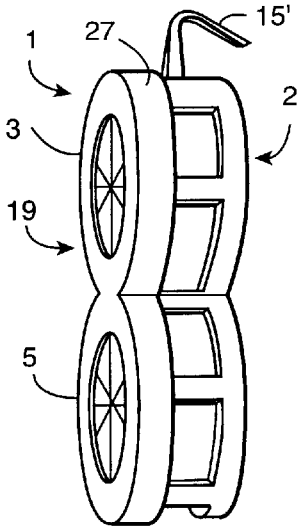
FIG. 8
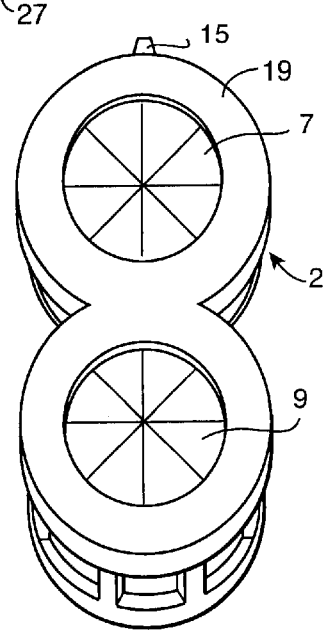
FIG. 9

FIG. 60
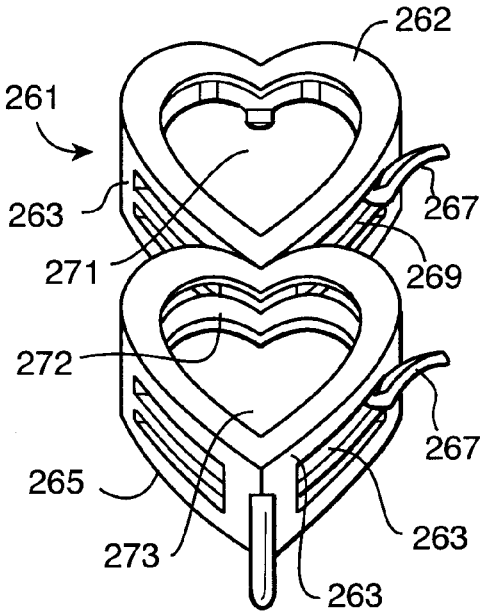
FIG. 61
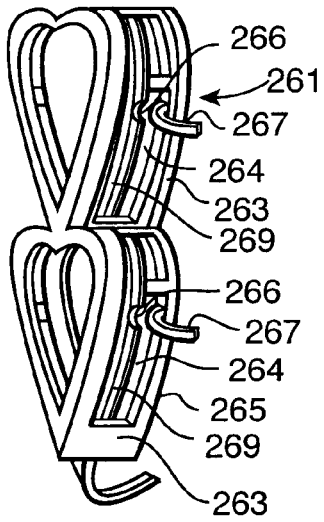
FIG. 62
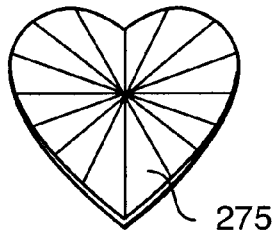
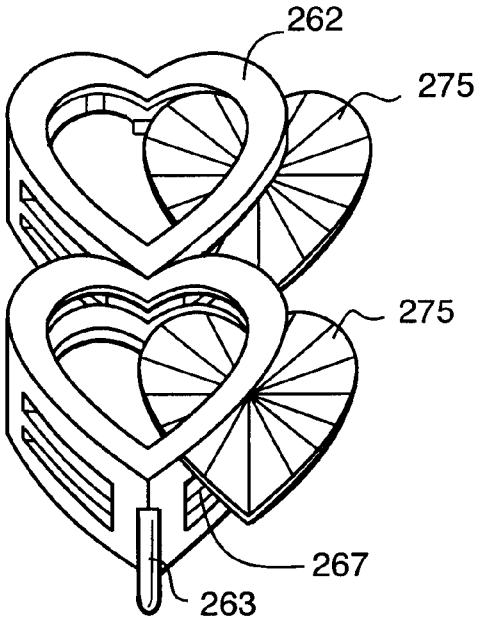
FIG. 63
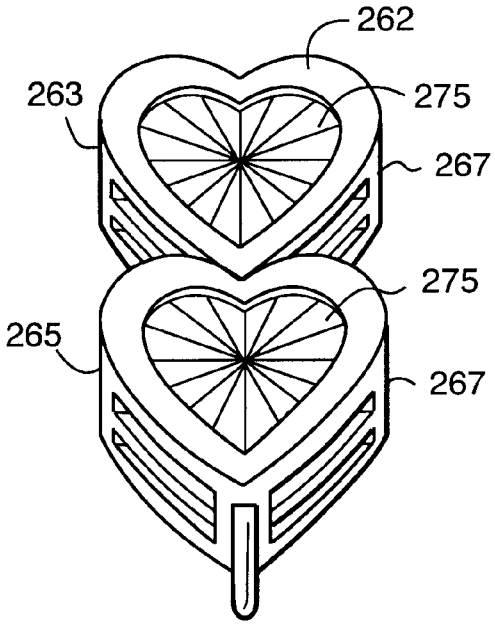
FIG. 64

DECORATIVE JEWELRY ITEM

CROSS REFERENCE TO RELATED APPLICATION

Reference is made to Applicant's prior U.S. application Ser. No. 09/224,936, filed Dec. 31, 1998 and entitled "DECORATIVE JEWELRY ARTICLE", now abandoned.

BACKGROUND OF THE INVENTION

1. Field of the Invention

This invention relates to items of jewelry, and in particular to a modular simulated gem and gem setting jewelry arrangement.

2. Brief Description of the Prior Art

Unitary jewelry items and/or modular links for forming jewelry bracelets, necklaces, pendants, and rings are well known. The so-called tennis bracelet, for example, is a bracelet having a series of connected modular units, each unit comprising an actual diamond or other gem and a setting therefor.

Reference is made to the following U.S. patents:

| U.S. Pat. No. | Inventor(s) |
|---|---|
| Des. 110,568 | L. Garfinkel |
| 1,189,497 | A. Schwartzman |
| 1,589,423 | H. Payton |
| 1,344,365 | H. Wachenheimer |
| 2,538,090 | H. Ferragamo |
| 4,781,038 | Branca et al. |
| Des. 146,779 | M. Slater |
| Des. 117,577 | J. Sand |
| Des. 257,017 | J. Barr |
| Des. 156,650 | W. W. Pearce et al. |
| 4,763,489 | L. Strong |
| Des. 48,950 | C. Rosenberger |
| 1,410,366 | E. H. Buchman |
| Des. 131,847 | W. W. Hobe |
| 1,153,362 | J. C. Wacha |
| Des. 42,643 | H. H. Meyers |
| Des. 176,664 | Adolph Katz |
| Des. 143,588 | O. Green |
| Des. 265,639 | Josef J. Barr |
| Des. 84,213 | A. E. R. Speidel |
| Des. 56,605 | H. Grasmuk |
| Des. 151,904 | A. Katz |
| Des. 145,426 | J. Braunstein |
| Des. 144,901 | J. Braunstein |
| Des. 160,241 | P. Bardach |

Reference is also made to prior U.S. patent applications of the inventor of the present invention as follows: patent application Ser. No. 07/572,678, filed Aug. 23, 1990 for "BRACELET DESIGN", which is a continuation application of Design application Ser. No. 397,094 filed Aug. 22, 1989 entitled "BRACELET OR THE LIKE"; and patent application Ser. No. 09/224,936 filed Dec. 31 1998 entitled "DECORATIVE JEWELRY ITEM".

Non-patent references of interest may include:

1. "Charms" catalog, Page 136, Item #136–20, by Americas GOLD, 650 South Hill St., Los Angeles, Calif. 90014
2. "Liberty Collections" catalog, Pages 4 and 21, by Liberty I. Exchange, 333 Washington St. #203-1, Boston, Mass. 02108;
3. "Diamond Flower" jewelry by S&R Designs, Inc., Marlton, N.J.;
4. Items #P10529, #84619, #84622, National Jeweler, May 16, 1997;

5. Janet Alix necklace, Jewelers' Circular Keystone, May, 1997;
6. Catalog Item #4D, Skalet Gold, 3600 N. Talman Ave., Chicago, Ill. 60618
7. Caroline Ballou Collection, June Las Vegas Show, K25–K27, and Barnett Robinson, Inc. June Las Vegas Show, Galleria #10;
8. Item N362, P.Q.C. Jewelry, National Jeweler, Jun. 1, 1998, Page 142;
9. "Love Tears" collection, by Studs, Inc., 42 W. 48 St., New York, N.Y. 10036;
10. Slide pendant, by Superior Diamond Cutters Inc., 589 Fifth Ave., New York, N.Y. 10017;
11. Uni-Creation, Inc., Emby International, Inc. collection, 589 Fifth Avenue, New York, N.Y. 10017;
12. A Promotional Supplement To JCK, May 1997, Pages 178, 179;
13. Item SS424, Corona Jewellery Company, 16 Ripley Ave., Toronto, Ontario, M6S 3N9, Canada;
14. "Bezel-set jewelry, California Gold Center, 606 S. Hill St., Los Angeles, Calif. 90014;
15. "Partners" fashion jewelry, Cache fashion watches, Mervyn's California catalog flyer, 1998, Page 11;
16. California Precision Products Co. Catalog "Laser Spot-Welding Systems", One Industrial Court, Riverside, R.I. 02915;
17. Maty, Collection Automne—Hiver 97–98, Valeur 30F, No. 76.

The jewelry items shown and described in the prior art noted above take on various aesthetically pleasing forms for displaying gems, real or simulated, in a variety of visual and structural configurations.

Channel settings and bezel settings that use real gems increase the price of a jewelry item dramatically.

In all such items of the prior art in which a gem or simulated gem is mounted in a gem setting, the gem or simulated gem is positioned brought down from above the setting and secured in place. In assembling the gem and gem setting combination, typically a series of upwardly directed prongs project from the setting, also referred to as a "base", and the gemstone, or simulated gemstone, is lowered to fit within the upwardly extending prongs, after which the series of prongs are bent inwardly and downwardly to embrace the gem or simulated gem. While this configuration displays the gem in the foreground relative to the setting, there are many disadvantages to such construction.

In particular, with the prongs of the setting exposed, it is relatively easy to snag clothing or inflict minor injuries to the skin of a person by an inadvertent scraping action. Moreover, the prongs of the setting base are unsightly, detracting from the aesthetic qualities of the item of jewelry.

If one were to conceive of the idea of avoiding the unsightliness of upwardly extending gem mounting prongs, the idea would be quickly rejected, due to the fact that if a precious stone, for example a diamond or ruby, is mounted below the upper surface of the setting base, the pointed bottom of the stone would penetrate the skin of the user even more so than is commonly done even with stones mounted from the top of a setting base or bezel. The pointed bottom of a precious stone is, by design, formed with specific depth and angles to capture as much light as possible for reflection through the stone, thereby enhancing the brilliance and spectacle of the gem.

Yet another disadvantage of the use of prior art unitary modules for connection in series to form a tennis bracelet, for example, is that such bracelet construction is rather labor intensive, each modular unit having to be connected to an adjacent unit, and for a bracelet with, typically thirty or more, individual modules, the cost of the bracelet to the ultimate consumer may be inflated beyond expectation of the purchaser who values the item of jewelry on the basis of its precious stone content. Typical prong, channel, and bezel settings not only use expensive gems that sometimes get damaged during the setting procedure, but these types of settings themselves are costly. The purchaser would be greatly benefitted by a less costly manufacturing process, since, for the same purchase price, the purchaser would receive more or larger stones, simulated or real. Such simulated or real stones of a greater quality. There is therefore a need in the art for reducing the manufacturing costs of multi-modular jewelry items.

One solution to avoid employing upwardly extending gem mounting prongs is found in the aforementioned U.S. patent application Ser. No. 09/224,936 in which a gem or simulated gem is inserted from below into a hollow base member having a top bezel with and opening therein to expose the gem or simulated gem below.

SUMMARY OF THE INVENTION

The present invention satisfies the needs and desires of the purchasing public while simultaneously solving the aforementioned problems associated with jewelry items in which the gem is mounted above the setting using upwardly protruding prongs. The invention thus solves the same problems as does the aforementioned '936 patent application, but in a different way, while offering certain additional features not found in the '936 application.

In accordance with one aspect of the present invention, there is provided a decorative jewelry item, comprising: a hollow base member having a decorative top; a cap with an opening therein; and a cap attachment arrangement for attaching the cap to the hollow base member with at least a portion of the decorative top being viewable through the cap opening.

The decorative top may be integral with the base member, or it may be defined by a top surface on the base member with a separate decorative object fixed to such top surface.

In accordance with another aspect of the present invention, there is provided a decorative jewelry item, comprising: a base member having a hollow interior, a top with an opening therein leading to the hollow interior, a bottom, and a sidewall extending from the top to the bottom, the sidewall having an opening therein leading to the hollow interior; a decorative insert configured and sized in relation to the base member to be inserted within the hollow interior through the sidewall opening and viewable through the top opening; and a retainer for retaining said decorative insert within said base member hollow interior.

In one preferred embodiment of the invention, the base member is segmented, defining a plurality of base member segments each having a decorative top, fixedly connected together side-by-side. Similarly, the cap is segmented, defining a like plurality of cap segments each having an opening therein, fixedly connected together side-by-side; and the cap attachment means is adapted to attach the segmented cap to the segmented base member with at least a portion of each decorative top being viewable through the cap openings.

The invention embodies both the construction or constructions of a decorative jewelry item as well as the method or methods for making a decorative jewelry item.

It will be appreciated that, in accordance with the principles and concepts of the present invention, since the decorative object, decorative insert, or simulated decorative object or insert, is typically positioned below the top of the decorative jewelry item and above the bottom of the base member, snagging of clothing, and penetration of the user's skin is avoided. Unlike real gems, the simulated gem of the present invention does not extend below the bottom of the base member in which it is contained.

In another aspect of the invention, there is provided a plurality of such decorative jewelry items joined together. For example, a pair of such decorative jewelry items may be joined together in the manufacturing process so that the number of individual modular units to be assembled, to form a tennis bracelet for example, is halved.

The present invention also provides for a number of selectable structural configurations and mounting processes, depending on need, desired security for a mounted gem or simulated gem, and aesthetic considerations.

BRIEF DESCRIPTION OF THE DRAWING

These and other aspects of the invention will be better understood, and additional features of the invention will be described hereinafter having reference to the accompanying drawings in which:

FIG. 1 is a front perspective view of a dual segment base member having an integral decorative top;

FIG. 2 is a rear perspective view of the base member shown in FIG. 1;

FIG. 3 is a side perspective view of the base member shown in FIG. 1;

FIG. 4 is a bottom perspective view of a dual segment cap for the base member shown in FIG. 1;

FIG. 5 is a front perspective view of the dual segment cap;

FIG. 6 is a side perspective view of the dual segment cap;

FIG. 7 is a side perspective view illustrating the method of placing a dual segment cap over the top of a dual segment base member;

FIG. 8 is a view similar to that of FIG. 7, but with the cap fully assembled to the base member, defining a finished decorative jewelry item;

FIG. 9 is a front perspective view of the assembled jewelry item shown in FIG. 8;

FIG. 60 is a front perspective view of a dual segment base member, each segment having a sidewall with an opening therein;

FIG. 61 is a side perspective view of the base member shown in FIG. 60;

FIG. 62 is a front perspective view of a decorative object to be inserted in the base member of FIGS. 60, 61;

FIG. 63 is a view similar to that of FIG. 60, with a pair of decorative objects shown in FIG. 62 being inserted into the sidewall openings in the base member;

FIG. 64 is a fully assembled dual segment decorative jewelry item comprised of the base member shown in FIG. 60 and a pair of decorative objects shown in FIG. 62;

DETAILED DESCRIPTION OF THE PREFERRED EMBODIMENTS

Figure 10:
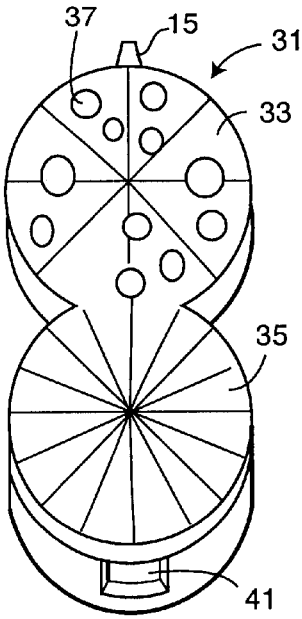
FIG. 10 is a front perspective view of a dual segment base member in which the decorative top of each segment exhibits a different visual appearance or property.

A first embodiment of the invention is shown in FIGS. 1–9. FIGS. 1–3 represent the front, rear, and side perspective views of the base member 2. In this embodiment, each decorative jewelry item 1 (FIG. 8), hereinafter also referred to as a module or modular link, is segmented to define two segments 3 and 5 in a substantially figure-8 shape. The dual segmented base member 1 has a segmented decorative top 7, 9, exhibiting a design representing a diamond cut surface on each segment. In the embodiment of FIGS. 1–9, the diamond cut design is formed integrally on the top surface of the base member 2. As will be described below, an alternate embodiment may employ a separate decorative object fixed to the top surface of the base member 2.

The base member 2 preferably has a hollow interior defined by a thin sidewall 6 extending downwardly from the decorative top 7, 9, the sidewall 6 having at least one cutout 13 extending through sidewall 6 into the interior of the base member 2. The cutout 13 is provided to accept a prong from a cap member to be described hereinafter.

To enhance the beauty of the decorative jewelry item, to lighten it, to conserve precious metal, and to make it have more of a delicate appearance, the sidewall 6 may be provided with a series of side windows 11 also opening to the interior of the hollow base member 2. The windows 11 provide a convenient placement for the cutouts 13, i.e. at the top of the window just beneath the decorative top 7, 9 of base member 2. It will be appreciated that a prong from above can be bent into window 11 and fill cutout 13 if the prong is bent over toward the interior of the base member 2.

A connector tongue 15 is provided at the rear of the decorative jewelry item for insertion into a front window 17 of an adjacent decorative jewelry item.

FIGS. 4–6 show a bottom, front, and side perspective view of a dual segment cap 19 designed and configured to fit over the top of the dual segment base member 2 and secured thereto.

As best understood by reference to FIGS. 4, 7, and 8, the inner diameter of each sidewall 27 of the segmented cap 19 has a diameter slightly greater than the respective decorative tops 7, 9 of the base member 2. Thus, when the cap 19 is brought down over the top of the base member 2 (see FIG. 7), the prongs 21 slide over the side of sidewall 3, 5 in alignment with cutouts 13, and the cap 19 ultimately fits over the top of base member 2 with the downwardly directed peripheral wall 27 covering a relatively small top portion of the base member sidewall 3, 5. After the cap 19 is in place, the prongs 21 are bent inwardly through the sidewall windows 11, and due to the width and depth of the cutout 13 being slightly larger than the width and thickness of the prongs 21, after prongs 21 are bent inwardly, they are not visible from a side viewing position of the completely assembled decorative jewelry item 1 (see FIG. 8).

As seen in FIG. 9, the finished decorative jewelry item is an attractive dual segmented modular link which can, when connected to other modular links of the same kind, form a tennis bracelet with the decorative diamond cut surfaces 7, 9 being seen through the openings 23, 25 of the cap 19.

Preferably, the embodiment of the invention shown in FIGS. 1–9 is provided with four windows 11 on each side of the decorative jewelry item, or two per segment side (see FIG. 3), with the two windows nearest the ends having a cutout 13 on the surface forming the windows 11. Since the decorative jewelry item is symmetrical, the embodiment of FIGS. 1–9 embodies a total of eight windows and four cutouts.

Similarly, as seen in FIG. 4, the cap 19 comprises four prongs 21, but the number of prongs 21 and window cutouts 13 can range from one to eight, or even more.

FIG. 10 is a front perspective view of a base member 31 in which, like the base member 2 of FIG. 1, is provided with an integral decorative top 33, 35 on two base member segments. The diamond cut surface of decorative top segment 35 is similar to that shown in FIG. 1, but with a larger number of radial cuts. However, the other decorative top 33 shows a lesser number of radial diamond cuts in the surface thereof, but such diamond cuts are formed after the decorative top segment 33 is provided with a number of holes 37. The holes can be arranged orderly, or, as seen in FIG. 10, they can be of random sizes, random shapes, and random positions on the decorative top 33.

Figure 11:
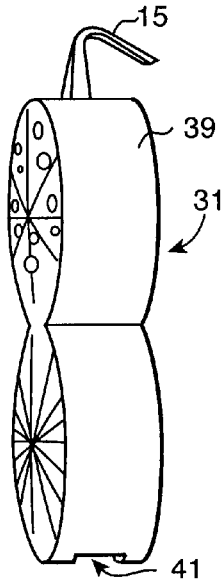
FIG. 11 is a side perspective view of the dual segment base as shown in FIG. 10.

FIG. 11 is a side perspective view of the base member 31 showing that no side windows are provided in the sidewall 39. A front end window 41 is formed at the opposite end from the connector tab 15 for accommodating the connector tab of an adjacent modular link when the finished decorative jewelry item is in the form of a tennis bracelet, for example. In such an arrangement, the connector tab 15 is inserted in an adjacent end window 41 and then bent around the bottom ledge of window 41.

Figure 12:
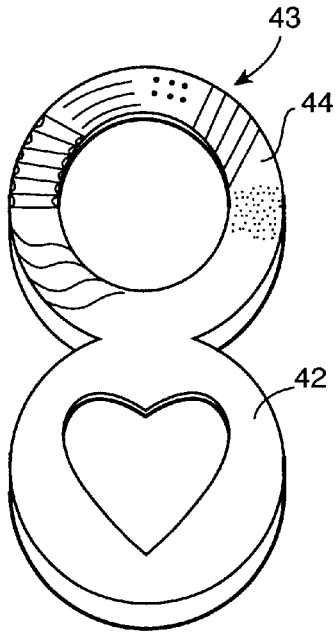
FIG. 12 is a front perspective view of a dual segment cap illustrating that a cap member may have any one of a variety of possible shapes for the openings therein and for the texturing and design of the major top surface of the cap.

FIG. 12 is the top view of a variation of the cap shown in FIG. 5, with no depending prongs. In FIG. 12, one-half of the cap 43 has a circular opening therein, while the other half has a heart shaped opening. The top surface 42 of the segment with a heart shaped opening is plain, while the segment with a circular opening contains multiple design patterns and textures on its top surface 44, it being understood that the designs and textures shown are examples only of what can be done to the surfaces. Preferably, there will not be multiple patterns on any surface of the cap, i.e. if the surface is to be textured, for example, then the whole top surface will be of the same texture.

Figure 13:
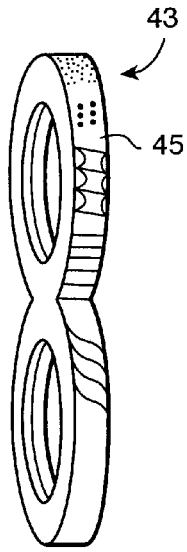
FIG. 13 is a side perspective view of a dual segment cap showing a variety of possible sidewall texturing or designs.

FIG. 13 is a side perspective view of a dual segment cap similar to that shown in FIG. 6, again without any mounting prongs. The side surfaces 45 of the cap 43 show multiple designs and texturing, and again if the side surface is to be textured, the entire side will be of the same texture. However, the design or texture on the side 45 of cap 43 does not necessarily have to correspond to the design or texture of the top surface.

Figure 14:
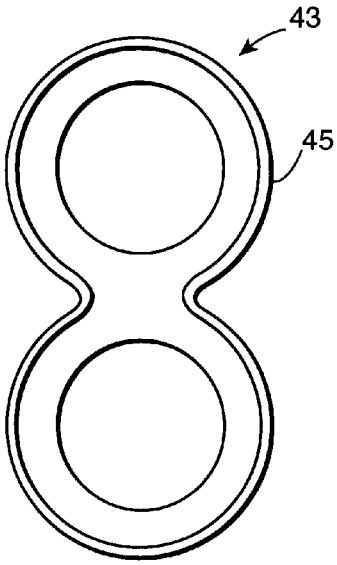
FIG. 14 is a bottom view of an alternate dual segment cap configuration without mounting prongs.

FIG. 14 shows the bottom view of the cap shown in FIG. 13, but without showing any design or texturing. Since there are no prongs, the sidewall 45 of cap 43 has an inner diameter slightly greater than the diameter of the segments of the base member 31, allowing the cap 43 to cover the top portion of the base a short distance.

Figure 15:
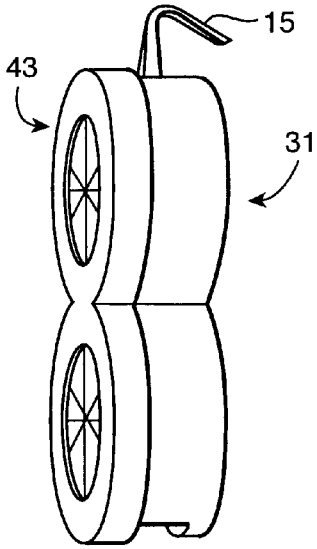
FIG. 15 is a fully assembled dual segment decorative jewelry item employing a base member similar to that shown in FIG. 11, and a cap structure similar to that shown in FIG. 14.

FIG. 15 shows the finished assembly of FIG. 11 and FIG. 13 with optional identical diamond cut decorative tops on the two segments of the base member 31 viewable through identical circular openings in the cap 43 which is devoid, in FIG. 15, of any design or texturing. Since there are no prongs or cutouts in the FIG. 15 assembly, the cap 43 is fixed to the base member 31 by means of soldering, welding, adhesive, or other known adhering processes.

FIGS. 16–24 are very similar to FIGS. 1–9, respectively, with some notable differences. One difference is that, in the embodiment of FIGS. 1–9, the top of the base member 2 has diamond cut patterns formed thereon, while in FIGS. 16–24, the decorative top of the base member 51 comprises a planar top surface 53, 57 upon which is fixed two separate, and individual, decorative objects, 55, 59. This is best viewed in FIGS. 17 and 18.

A second difference to be noted is that a number of vertical channels 61 are provided around the periphery of the base member 51, channels 61 extending through the top surface 53, 57 of the base member 51 downwardly to corresponding open windows 56 in the sidewalls of the base member segments 52, 54. The windows 56 correspond in number and placement the same as windows 11 of the embodiment of FIGS. 1–9. Preferably, the channels 61 are provided in alignment with the outermost windows, i.e. the sidewall windows 56 closest to the short ends of the dual segment decorative jewelry item.

Figure 19:
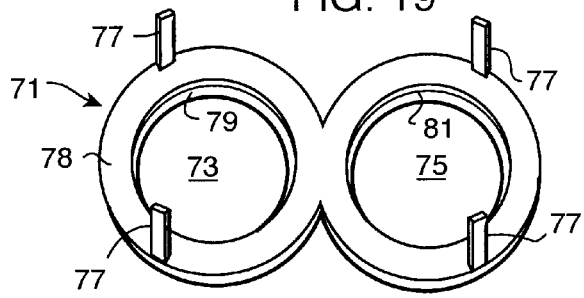
FIG. 19 is a bottom perspective view of a dual segment cap for the base member shown in FIG. 16.
Figure 20:
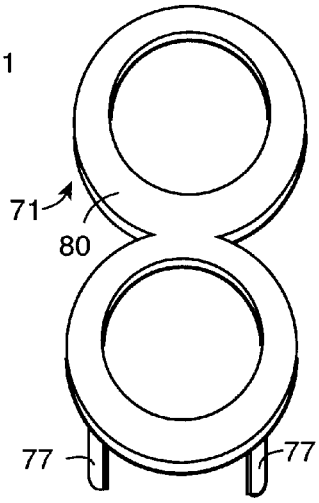
FIG. 20 is a front perspective view of the dual segment cap.
Figure 21:
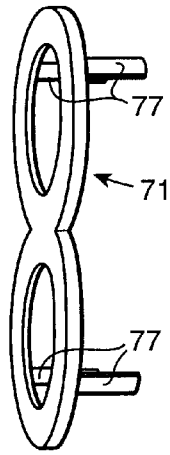
FIG. 21 is a side perspective view of the dual segment cap.
Figure 22:
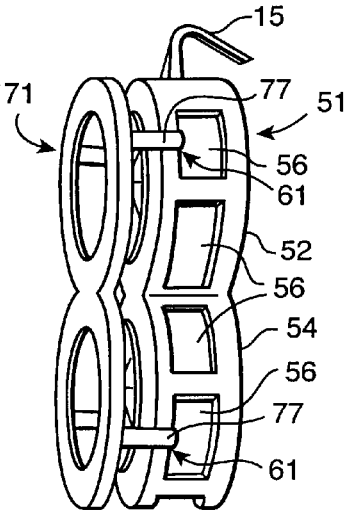
FIG. 22 is a side perspective view illustrating the method of placing of a dual segment cap over the top of a dual segment base member.

The purpose for the channels 61 can be appreciated by referring to the associated cap 71 shown in FIGS. 19–21, in which a plurality of rectangular prongs 77 extend from the lower surface of the cap 71 and are not visible in a top view due to such placement. The cap 71 has a pair of openings 73, 75 through which the decorative objects 55, 59 can be observed when the decorative jewelry item is completely assembled. As seen in FIG. 19, a recess 79, 81 is provided in each segment of the dual segment cap 71, the diameter of the decorative objects 55, 59 being larger than the diameter of the cap openings 73, 75, but smaller than the diameter of the recesses 79, 81. Unlike the cap 19 shown in FIGS. 4–6, the cap 71 is the same length and width as the base 51. In FIG. 19, the cap 71 is shown to have a flat bottom surface 78, and the recess 79 is not as noticeable compared to the recess 24 of cap 19, recess 79 intending to cover only the diamond cut decorative objects 55, 59 projecting into the cap recesses 79, 81.

Thus, when the cap 71 is brought down over the top of base member 51, since both cap 71 and base member 51 have the same length and width, prongs 77 fit perfectly into and slide through channels 61 until the cap 71 is seated on the base member 51 with the bottom of the cap resting on the top surface 53, 57 of the base member 51, and the decorative objects 55, 59 being framed by the openings 73, 75 in the cap 71.

The two decorative objects 55, 59 are described separately in this description to indicate that the design and shape of such decorative objects 55, 59 need not necessarily be identical as they appear to be in FIGS. 16–24.

Figure 23:
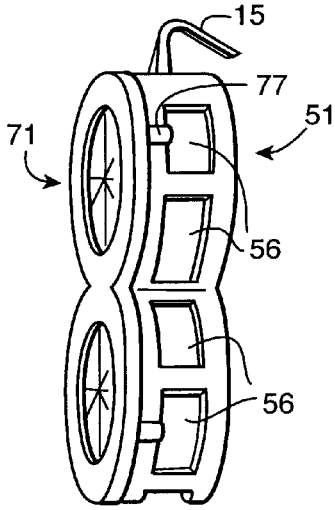
FIG. 23 is a view similar to that of FIG. 22, but with the cap fully assembled to the base member, defining a finished decorative jewelry item.

After contact between the cap 71 and base member 51, the prongs 77 are bent inwardly through the respective windows 56, and, because the thickness of the prongs 77 is made to be the same as the depth of channels 61, after the prongs 77 are bent over, as shown in FIG. 23, the prong/channel attachment arrangement is barely visible.

Figure 16:
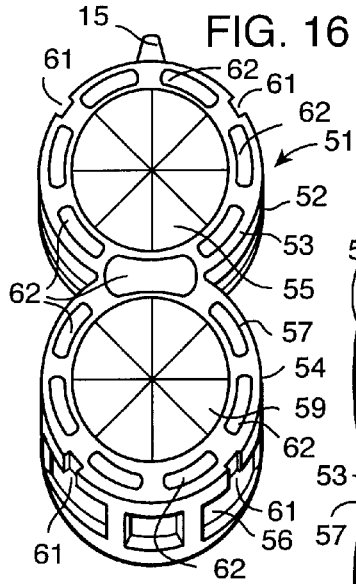
FIG. 16 is a front perspective view of a dual segment base member having a decorative top, the base member decorative top including a base member top surface and a separate decorative object fixed thereon and a number of mounting channels on the sides of the base member.
Figure 17:
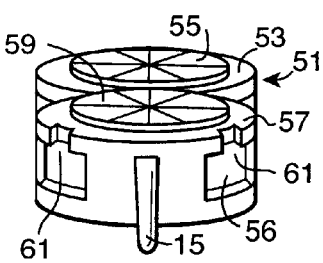
FIG. 17 is a rear perspective view of the base member shown in FIG. 16.
Figure 18:
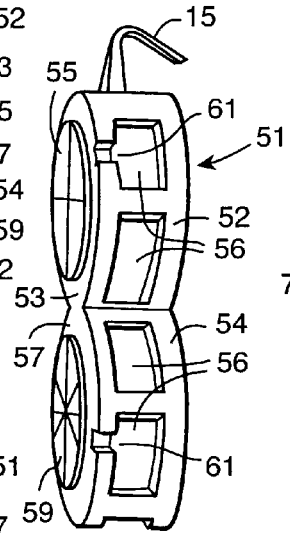
FIG. 18 is a side perspective view of the base member shown in FIG. 16.

A third difference is seen in the provision of a number of through holes 62 formed in the surface of the base member top surfaces 53 and 57 outside the periphery of the decorative objects 55 and 59 (shown in FIG. 16 only, for convenience). The purpose of these through holes 62 is to reduce the amount of precious metal or material of the base member 52, 54. By placing the holes 62 in a pattern such as that shown in FIG. 16, a significant amount of base material, e.g. gold, will be saved, and yet the physical integrity of the finished decorative jewelry item will not be diminished. Because the holes 62 are covered and hidden from view by the cap 71, they will not detract from the beauty of the item. Additionally, such through holes 62 in the base member 52, 54 will also lighten the article of jewelry, e.g. a tennis bracelet, which comprises a number of decorative jewelry items 51. This would be a desirable feature especially for women. Through holes of this type for reducing the amount of precious metal or material can be formed in virtually all of the decorative jewelry item base members shown and described herein, and the variation shown in FIG. 16 is to be considered exemplary only.

Figure 24:
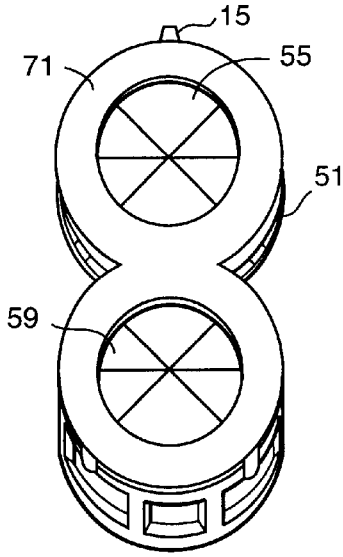
FIG. 24 is a front perspective view of the assembled jewelry item shown in FIG. 23.

FIG. 24 is a front perspective view of the completely assembled decorative jewelry item employing the base 51 and cap 71, as described.

Figure 25:
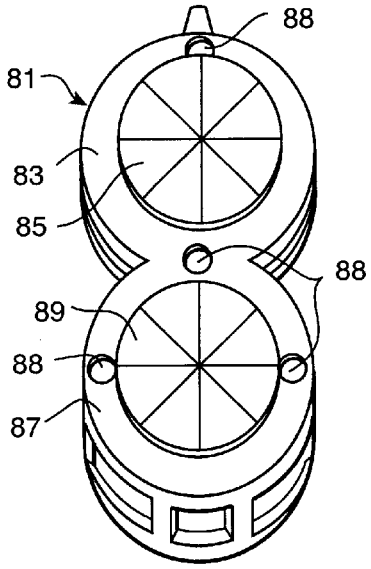
FIG. 25 is a view similar to that of FIG. 16 with circular through holes in the top surface of the dual segment base member replacing the channels shown in FIG. 16.
Figure 26:
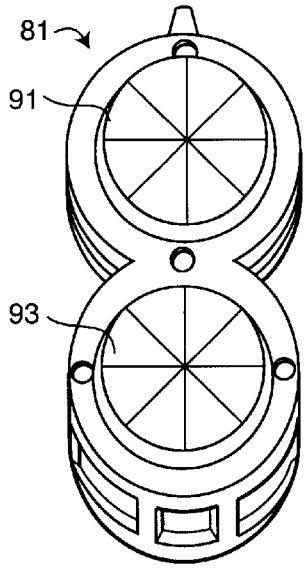
FIG. 26 is a view similar to that of FIG. 25 with the exception that each separate decorative object placed on the top surface of the dual segment base member has a greater thickness than that shown in FIG. 25.
Figure 27:
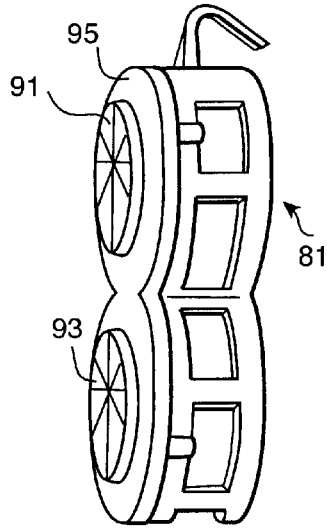
FIG. 27 is a dual segment completed decorative jewelry item employing the thickened decorative object shown in FIG. 26 which protrudes through the cap of the assembly.

FIGS. 25–27 show another attachment arrangement for attaching a cap to a base member. In these figures, the base member 81 has a planar top surface on the two segments 83, 87 upon which are fixed a pair of decorative objects 85, 89. In the top surface 83, 87 of the base member 81, a number of circular holes 88 are formed, and a cap 95, similar to that shown in FIG. 19 is provided, but with the depending prongs being circular in cross section and positioned on the bottom surface of the cap 95 away from the outer peripheral edge and to be in alignment with holes 88 of the base member 81. Thus, when the cap 95 is brought down over the top of base member 81, the prongs will slide through holes 88 and be bent over (not shown) in the interior of the hollow base member 81. The number of holes 88, and the number of prongs, can vary from one to eleven, or even more.

The base member of FIG. 26 is similar to that shown in FIG. 25, except that the thickness of the two decorative objects 85, 89 are considerably thicker. A cap 95 is chosen to have a central opening just slightly larger than the diameter of the thickened decorative objects 91, 93, such that when the cap is brought down over the base member 81, the thickened decorative objects 91, 93 project through and extend above the top surface of the cap 95, as best seen in FIG. 27 showing the completed article.

Figure 28A:
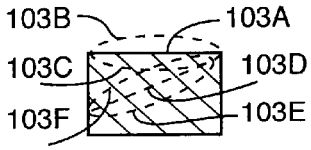
FIG. 28A is an enlarged cross section of one side of the cap segment taken along the line 28A—28A in FIG. 28.
Figure 28:
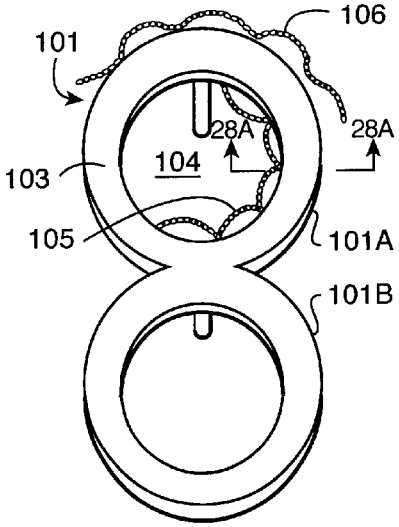
FIG. 28 is a dual segment cap illustrating the possibility of a non-planar top surface of the cap and the possibility of at least partially covering the opening in the cap with a filagree-like structural design.

FIG. 28 shows a variation of a cap 101 having a pair of annular shaped segments 101A, 101B with the top surface 103 of each cap segment being conical/concave in shape to enhance the beauty of the finished product. FIG. 28 also shows the possibility of adding an open filagree-like design structure 105 to the inner periphery of the opening 104 and/or an open filagree-like design structure 106 to the outer periphery of the cap segments 101A, 101B.

FIG. 28A is a cross section of one side of the cap segment 101A taken along the line 28A—28A in FIG. 28. This figure illustrates, in solid and dashed lines, several possibilities for the shape of the top surface 103, i.e., a planar and horizontal shape 103A, a convex shape 103B, a concave shape 103C, a linear conical shape 103D, a conical-concave shape 103E, and a conical-convex shape 103F. These shape variations can be chosen by the designer for cap configurations other than annular; for example, such shapes can be applied to a heart shaped cap segment such as those shown in FIG. 29.

Figure 29:
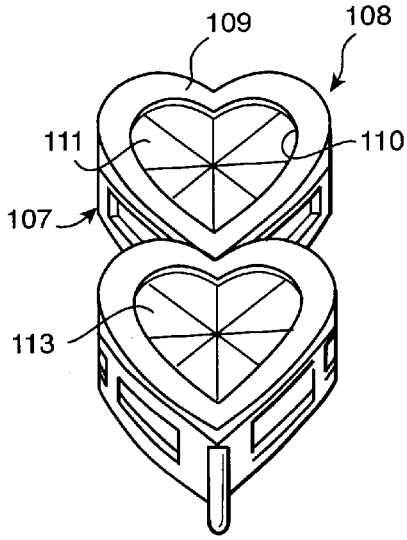
FIG. 29 is a dual segment finished decorative jewelry item in which the base member segments and the cap segments are heart shaped, and the top surface of the cap segments are concave.

FIG. 29 shows a finished decorative jewelry item in which both segments of the base 107 are heart shaped and both segments of the cap 108 are heart shaped and, like that of FIG. 28, the cap 108 has a concave peripheral upper surface 109 and a heart shaped opening 110 to expose the decorative objects 111, 113 beneath.

Figure 30:
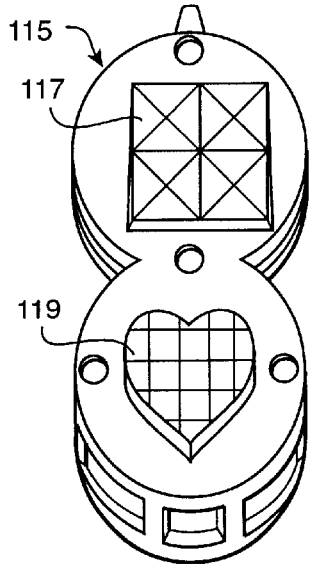
FIG. 30 is a view similar to that shown in FIG. 25, but with the fixed decorative objects mounted on the top surface of the base member being of different shapes and designs for the two segments.

FIG. 30 illustrates the possibility that the decorative objects 117, 119 fixed to the base member 115 may be of any particular desirable configuration and formed by any means of diamond cutting or other surface enhancing processes. In FIG. 30, the top decorative object 117 is square in configuration with crisscross diamond cut features, and the lower decorative object 119 is heart shaped with a square matrix of diamond cutlines.

It will be understood that the geometric shape of the opening in any cap in accordance with the present invention need not be the same geometric shape as the decorative object below. For example, instead of using a heart shaped decorative object 119 in FIG. 30, a square or circular shaped decorative object could be fixed to the base member 115, and the opening in a cap (not shown) fitted over base member 115 may be heart shaped.

Figure 31:
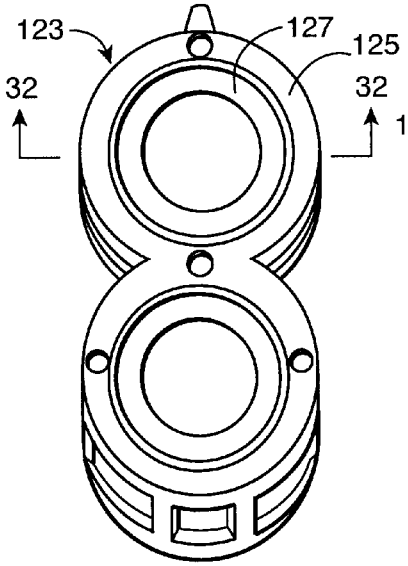
FIG. 31 is a front perspective view of a dual segment base member having a recess formed concentrically in each of the segments.
Figure 32:
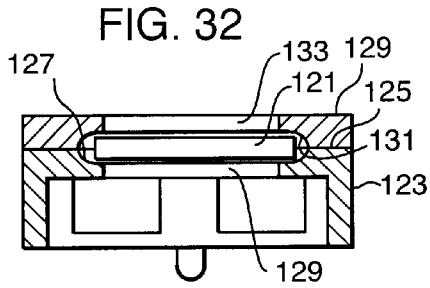
FIG. 32 is a cross sectional view of one of the segments of the base member shown in FIG. 31, taken along the line 32—32, with a separate decorative object captured loosely in the recess of the base member and between the base member and applied cap.
Figure 33:
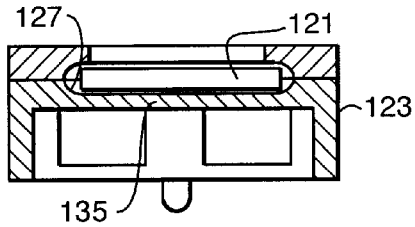
FIG. 33 is a view similar to that of FIG. 32, but without and opening in the bottom of the recess in the base member.

FIGS. 31–33 show embodiments of the invention into which a decorative object 121 is loosely captured or entrapped between a base member 123 and a cap 129. The base member shown in FIG. 31, for example, has a planar upper surface 125 and a pair of concave, or right angled, recesses 127. The bottom of the recess 127 may have an opening 129 in it to conserve precious metal material, since that part of the finished jewelry item will not be seen.

FIG. 32 is a cross sectional view taken along the line 32–32 in FIG. 31, wherein it can be seen that when the cap 129 is brought into contact with the planar surface 125 of the base member 123, there exists a void within the decorative jewelry item within which the decorative object 121 is loosely contained. This permits the decorative object 121 to move around within the confines of the finished decorative jewelry item, giving an interesting aspect to the item of jewelry.

In addition to, or instead of, providing a recess 127 in the base member 123, the cap 129 may be provided with a recess 131 of sufficient depth to permit the loose mounting of the decorative object 121 captured between the cap 129 and the base 123. For example, a cap designed similar to that shown in FIG. 19, but with a greater depth for the recess 131 could be employed for this purpose. Importantly, the opening 129 in the base member 123 and the opening 133 in the cap 129 are smaller in dimension than the decorative object 121 so as to avoid the possibility of the decorative object 121 falling out of its setting.

FIG. 33 is similar to that of FIG. 32 with the exception that the bottom 135 of the recess 127 of base member 123 has no opening.

Figure 34:
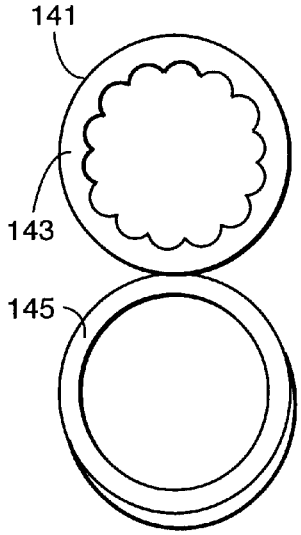
FIG. 34 is a top view of a dual segment cap illustrating different shape and size possibilities for the cap segments, and in particular a wavy inner edge and a thin annular configuration.
Figure 35:
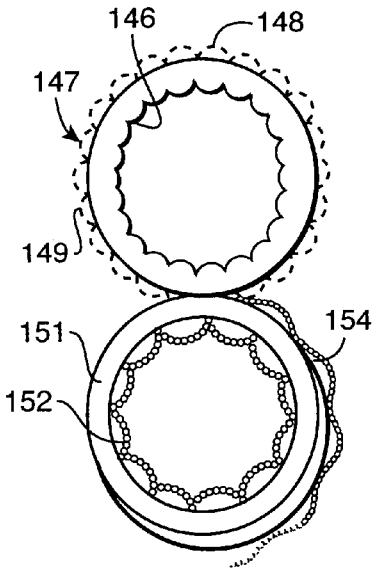
FIG. 35 is a top view of a dual segment cap illustrating different shape and size possibilities for the cap segments, and in particular a scalloped interior edge and a fillagree pattern structure.
Figure 36:
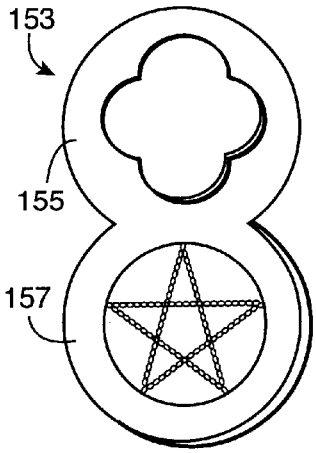
FIG. 36 is a top view of a dual segment cap illustrating different shape and size possibilities for the cap segments, and in particular a cloverleaf-like interior edge and star shaped fillagree pattern structure.
Figure 37:
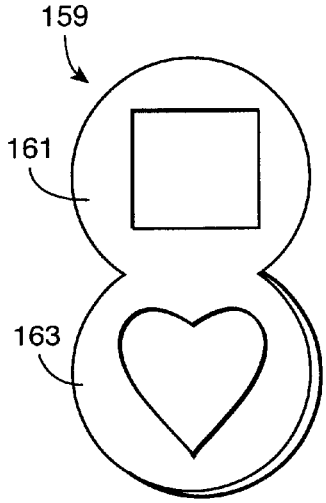
FIG. 37 is a top view of a dual segment cap illustrating different shape and size possibilities for the cap segments, and in particular a square interior edge and a heart shaped interior edge.

FIGS. 34–37 show, schematically, several possible shapes and configurations for the cap openings. The outer shapes for the caps in these figures is, but is not limited to, a figure-8 shape. The cap 141 of FIG. 34 shows a cap segment having an undulated or wavy interior edge, while the annular cap segment 145 is intended to show that the radial width of the cap segment can be made quite thin, whereby a decorative object may be exposed through the opening therein, while the surface of a base member upon which it is mounted may also be exposed to view and display interesting surface textures or designs (see FIG. 43, for an example). When the outer diameter of the bottom cap segment 145 is, instead, made equal to the outer diameter of the base member segment, the thinness of the cap segment 145 will display the decorative top of the base member larger than a regular sized cap opening. FIG. 35 shows a cap 147 with one segment 149 having a scalloped interior edge 146 and/or a scalloped exterior edge 148 (shown as an option in dashed lines), and the other cap segment 151 having a thin annular width with an open filagree-like pattern design 152 formed on the inner peripheral surface and/or an open filagree-like design 154 formed on the outer peripheral surface. FIG. 36 shows a cap 153 with one cap segment 155 having a cloverleaf or wide cross opening, while the other segment 157 has a circular opening with a filagree-like or thin filament arrangement forming a star over the opening therein. FIG. 37 shows a cap 159 in which one segment 161 has a square opening therein, and the other segment 163 has a heart shaped opening.

It is to be understood that interior and exterior shapes or designs of the cap segments of a dual segment decorative jewelry item may be the same for both segments, or they may be different. For example, FIGS. 34–37 show different designs for the two segments, but a designer may choose to make both segments identical, choosing the desired design for each segment from any one of the examples illustrated or suggested by such illustrations.

Figure 38:
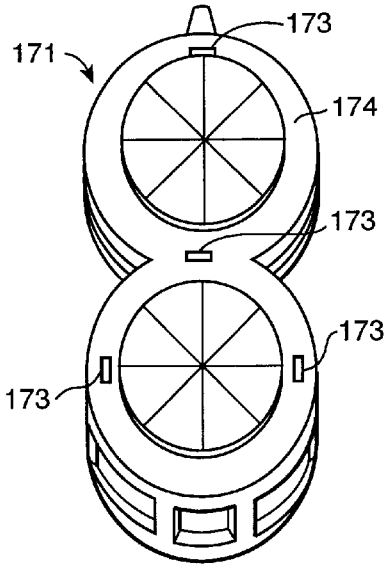
FIG. 38 is a front perspective view of a dual segment base member having rectangular openings in its top surface as opposed to the circular openings shown in FIG. 25.

FIG. 38 is a view similar to that shown in FIG. 25, but with the prong openings 173 in the upper surface 174 of base 171 being rectangular instead of circular.

Figure 39:
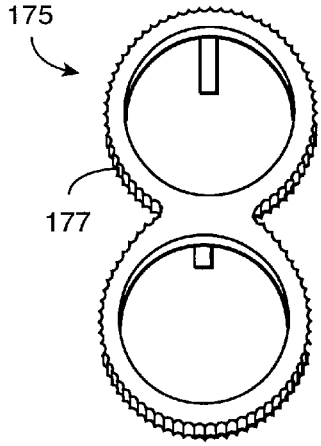
FIG. 39 is a front perspective view of a dual segment cap in which the outside edge is serrated, and the cap has a thin annular radius for each segment.
Figure 40:
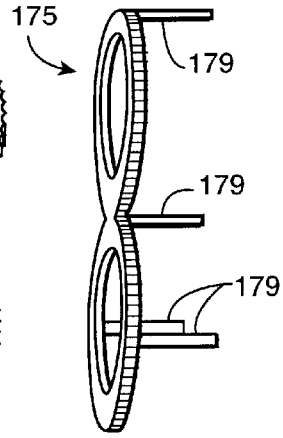
FIG. 40 is a side perspective view of the dual segment cap shown in FIG. 39.

FIGS. 39 and 40 show a front and side perspective view of a cap 175 which has the shape of a figure-8 and has serrations along its entire outer peripheral surface. Additionally, the prongs 179 are rectangular in shape so as to fit within the rectangular openings 173 of the base member 171 shown in FIG. 38.

Figure 41:
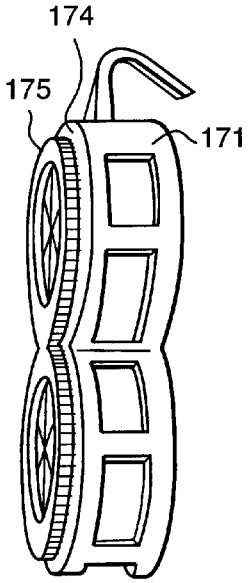
FIG. 41 is a side perspective view of an assembled decorative jewelry item employing the base member from FIG. 38 and the cap from FIG. 39.
Figure 42:
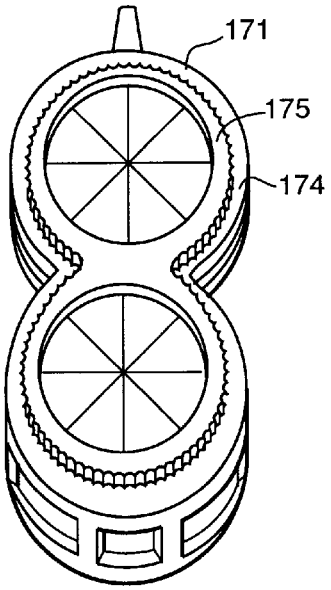
FIG. 42 is a front perspective view of the assembled decorative jewelry item shown in FIG. 41.

FIGS. 41 and 42 are side perspective and front perspective views, respectively, of the assembled decorative jewelry item employing the base 171 of FIG. 38 and cap 175 of FIG. 39. In these figures, it will be observed that the cap 175 has a pair of circular openings exposing the decorative objects below, while the thin radial width of each cap segment is such that a large portion of the upper surface 174 of base 177 is exposed outside of the serrated outer edge of cap 175.

Figure 43:
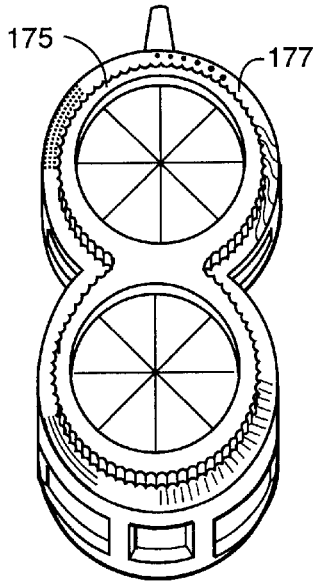
FIG. 43 is a view similar to that of FIG. 42 showing possible major surface texturing or designs for the portion of the top surface of the base member extending radially outwardly of the annular cap segments surrounding the decorative objects fixed to the top surface of the base member segments.

FIG. 43 shows the possibility of providing surface texturing or design features in the portion of the upper surface 177 exposed outside of the installed cap 175.

Figure 44:
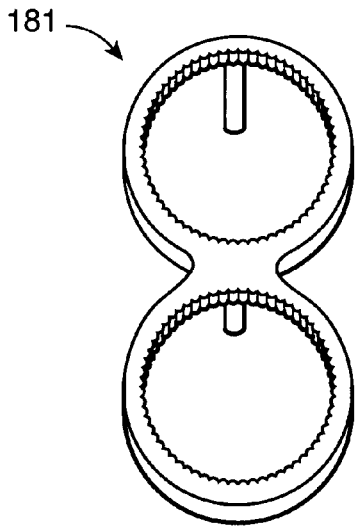
FIG. 44 is view similar to that shown in FIG. 39, except that the outer surface of the cap is plain and smooth, and the inner edge surfaces are serrated.

FIG. 44 is a view similar to that shown in FIG. 39, except that the outer peripheral surface of the cap 181 is smooth, while the interior surface of the two openings therein is serrated, or otherwise textured.

Figure 45:
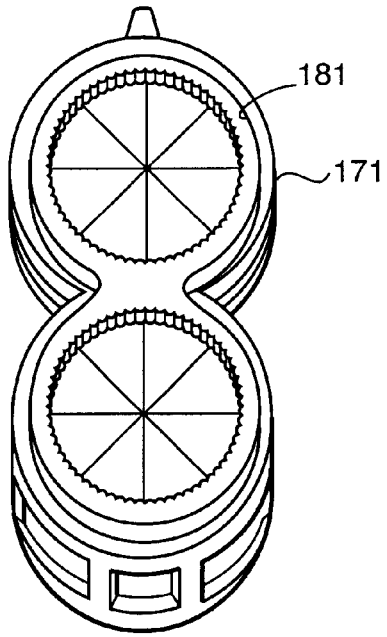
FIG. 45 is a front perspective view of a finished decorative jewelry item employing the base member from FIG. 38 and the cap from FIG. 44.

FIG. 45 is a view similar to that of FIG. 42, except that the cap has the features of FIG. 44 instead of those of FIG. 39. If desired, the top surface of cap 181 may also be serrated, or it may have a conical appearance.

Figure 46:
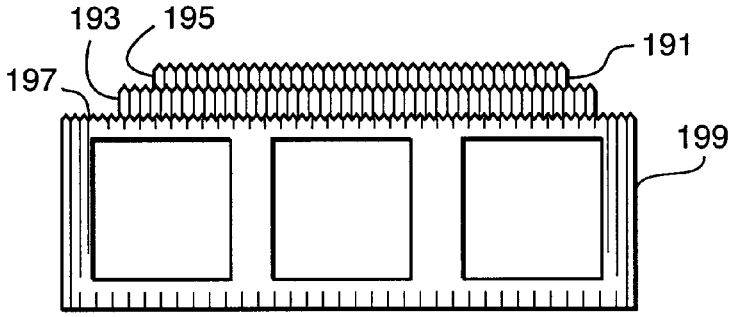
FIG. 46 is a front elevation view of a multi-stepped cap, with each exterior edge serrated, mounted on a base member having a textured top surface.

FIG. 46 is a side view of a decorative jewelry item in which the cap 191 has a multi-stepped configuration, in FIG. 46 only a non-limiting two-step configuration being shown. The outer edges of both stepped portions 193, 195 are serrated, or otherwise textured, and the top surface of each step 193, 195 is also serrated or otherwise textured. For consistency of design, the base member 199 may also be provided with a serrated or otherwise textured upper surface 197.

Figure 47:
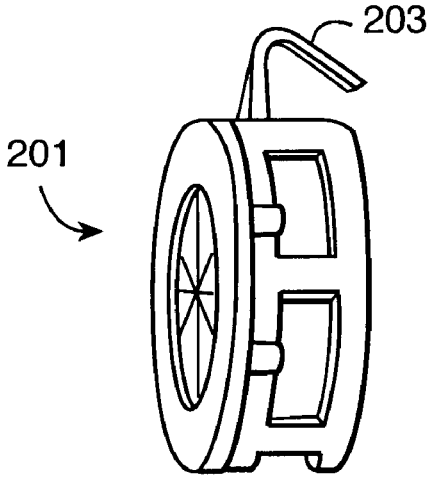
FIG. 47 is a single non-segmented decorative jewelry item having features similar to the dual decorative jewelry item shown in FIG. 23.

FIGS. 47–54 depict single non-segmented decorative jewelry items suggesting several options in the manufacture of such single non-segmented jewelry items. For example, FIG. 47 is a single segment version of the arrangement shown in FIG. 23, the decorative jewelry item 201 having a connector tab 203 for connecting to a similar decorative jewelry item in forming a necklace or tennis bracelet, for example.

Figure 48:
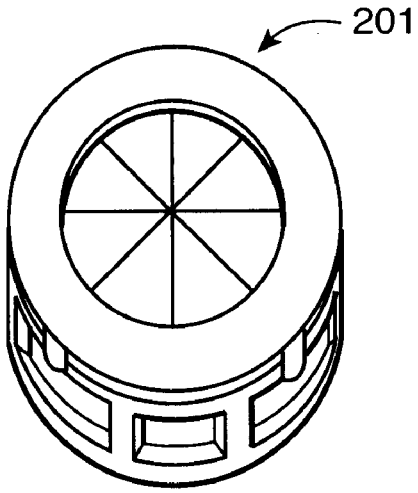
FIG. 48 is a front perspective view of the single decorative jewelry item shown in FIG. 47.

FIG. 48 should be understood to represent a front perspective view of the decorative jewelry item 201 shown in FIG. 47, or it can be understood that the variation shown in FIG. 48 does not have a connector tab 203, and therefore may be inserted into a cylindrical pocket of a larger article of jewelry such as a necklace, pendant, ring, or the like, to be described hereinafter.

Figure 49:
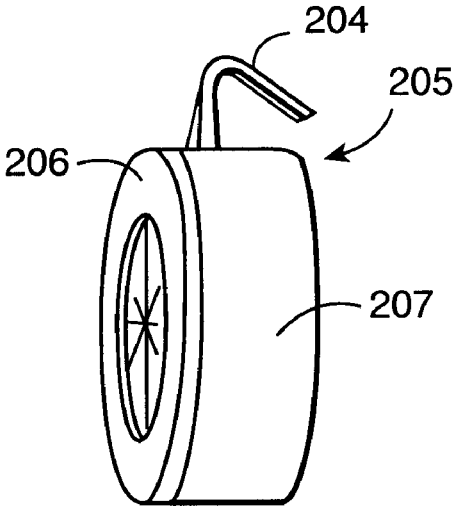
FIG. 49 illustrates the possibility of constructing a single non-segmented decorative jewelry item without employing prongs on the cap and without providing windows in the sidewalls of the base member.

FIG. 49 shows a side perspective view of a decorative jewelry item 205 having a sidewall of base member 207 with no windows formed therein, meaning that the cap 206 is fixed to the base member 207 by means of depending tabs bent over inside the hollow base member 207 or is soldered, welded, or otherwise bonded to base.

Figure 50:
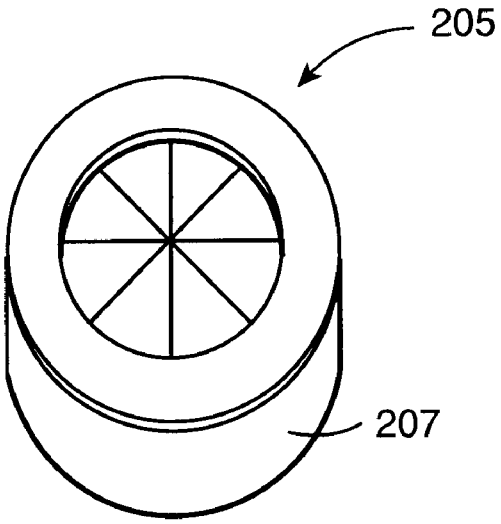
FIG. 50 is a front elevational view of the single decorative jewelry item shown in FIG. 49.

FIG. 50 is a front perspective view of the decorative jewelry item of FIG. 49, but it also may represent a view of a decorative jewelry item 205 without any connector tab 204.

Figure 51:
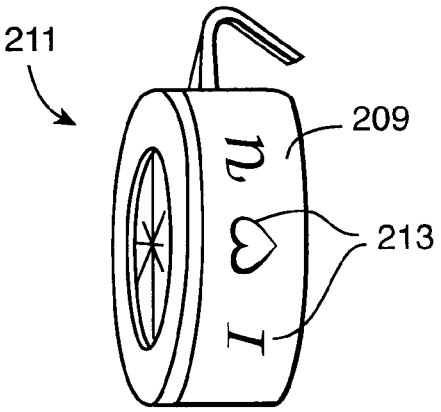
FIG. 51 is a side perspective view of a single non-segmented decorative jewelry item similar to that shown in FIG. 49, but with lettering and/or designs being formed on the sidewall of the base member.

FIG. 51 is a view similar to that shown in FIG. 49, except that the sidewall 209 of the decorative jewelry item 211 has formed therein or thereon a selection of letters and/or symbols 213. The designs and patterns may be cutouts or engravings of shapes and/or letters.

Figure 52:
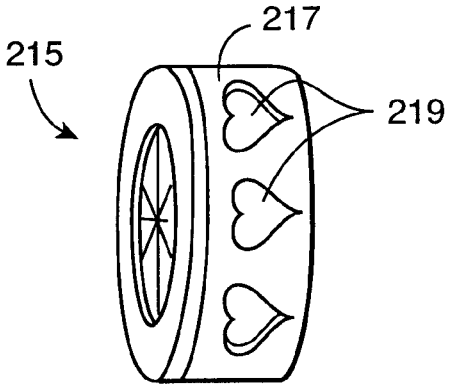
FIG. 52 is a side perspective view of a single non-segmented decorative jewelry item similar to that shown in FIG. 49, but with designed openings in the sidewall of the base member and without any means for attaching to another decorative jewelry item.

FIG. 52 is a side perspective view similar to that shown in FIG. 51 of a decorative jewelry item 215 in which the sidewall 217 has designed openings 219 therein, in FIG. 52 such openings 219 being heart shaped.

Figure 53:
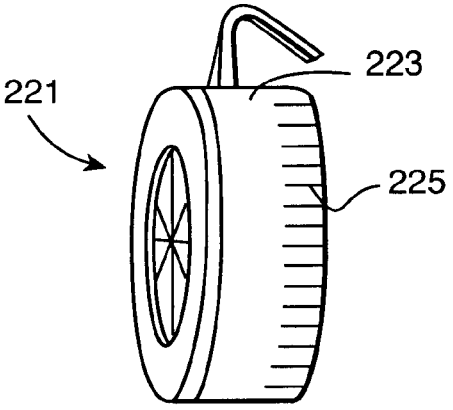
FIG. 53 is a side perspective view of the single non-segmented decorative jewelry item as shown in FIG. 49, except that at least a portion of the sidewall exhibits a line pattern.

FIG. 53 shows a decorative jewelry item 221 similar to that shown in FIG. 49, except that a line pattern is formed on the sidewall 223. The line pattern may be placed over the entire sidewall outer surface or on only selectable locations, at the whim of the jewelry designer.

Figure 54:
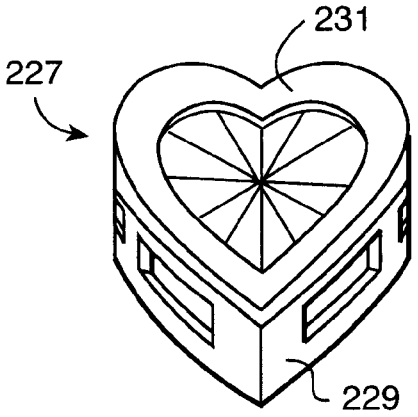
FIG. 54 is a front perspective view of a single non-segmented decorative jewelry item similar to that shown in FIG. 48, except that the base member and cap are heart shaped, and the cap top surface is concave.

FIG. 54 shows a single non-segmented decorative jewelry item 227 having a heart shaped base 229 and a heart shaped cap 231 with a concave upper surface.

Figure 55:
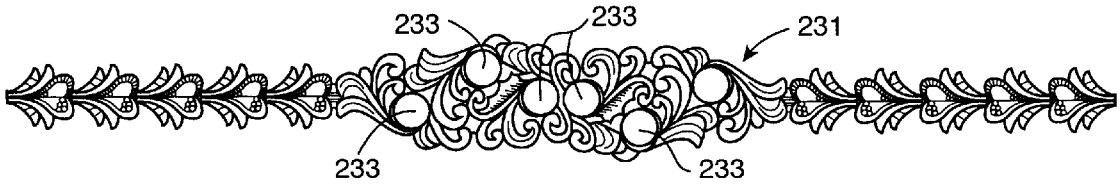
FIG. 55 shows a length of a piece of jewelry, such as a bracelet, having a center structural portion with a number of cylindrical pockets which can receive single non-segmented decorative jewelry items made in accordance with the present invention, such as those shown in FIGS. 48, 50, and 52.

FIG. 55 shows a length of bracelet 231 of arbitrary design having a number of cylindrical pockets 233 formed therein. The pockets 233 are sized to accept any of the single cylindrical non-segmented decorative jewelry items described herein, for example the decorative jewelry item 205 of FIG. 50. An appropriate attaching process is employed to fix the decorative jewelry item 205 in place, such as by soldering, welding, adhesives, etc. Alternatively, instead of forming the bracelet 231 with pockets 233 for insertion of the base member 207 of a complete decorative jewelry item 205, the bracelet 231 itself may be provided with an integral base portion, also numbered 233 in FIG. 55, formed, for example, by casting. With such a construction, there are two possibilities for providing a decorative top for such integral base portion. One possibility is to place a decorative object on the top of the integral base portion, fixed or loose, and fit a cap over the decorative object the same as previously described for a decorative jewelry item employing a separate base member construction. Another possibility is to form the base portion 233 to extend slightly above its surroundings, and form a diamond cut design in the top of the integral base portion 233. Thereafter, only a cap needs to be fitted over the integrally formed base portion 233 to complete the decorative jewelry item. Of course, if the top of the integral base portion 233 extends outwardly far enough, a cap may be applied first, and then the top of the integral base portion 233 can be diamond cut.

Figure 56:
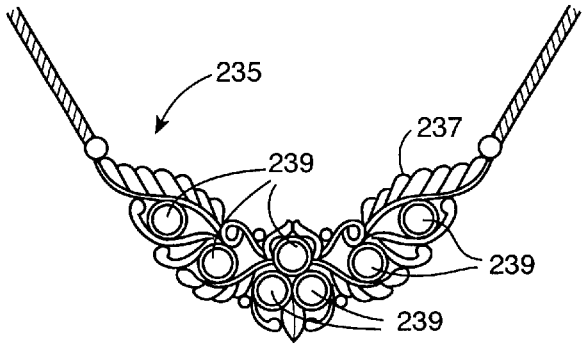
FIG. 56 shows a length of a piece of jewelry, such as a necklace, having a center structural portion with a number of cylindrical pockets which can receive single non-segmented decorative jewelry items made in accordance with the present invention, such as those shown in FIGS. 48, 50, and 52.

FIG. 56 is a portion of a necklace 235 having a center piece 237 of arbitrary design and also containing a number of cylindrical pockets 239 formed therein. Again, an insertable decorative jewelry item such as that shown in FIG. 50 may be fixedly attached within the cylindrical pockets 239. Alternatively, as with the bracelet of FIG. 55, a base, also numbered 239 in FIG. 56, may be integrally formed when the necklace center piece is formed.

Figure 57:
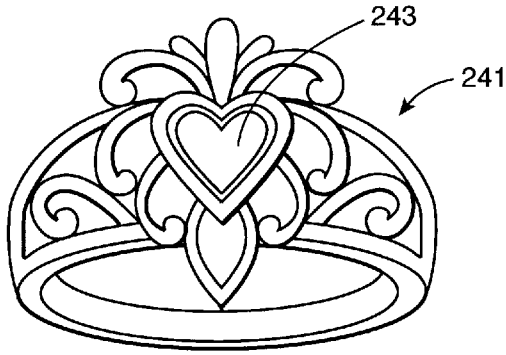
FIG. 57 is a front perspective view of a finger ring having a heart shaped pocket formed therein for receiving a single non-segmented decorative jewelry item made in accordance with the present invention, such as that shown in FIG. 54.

FIG. 57 shows a front perspective view of a finger ring of arbitrary design, except that a front central area of the ring 241 has a heart shaped pocket 243 formed therein for accepting a single non-segmented decorative jewelry item such as that shown in FIG. 54. Alternatively, as with the bracelet of FIG. 55, the base, also numbered 243 in FIG. 57, may be integrally formed when the ring is formed.

Figure 58:
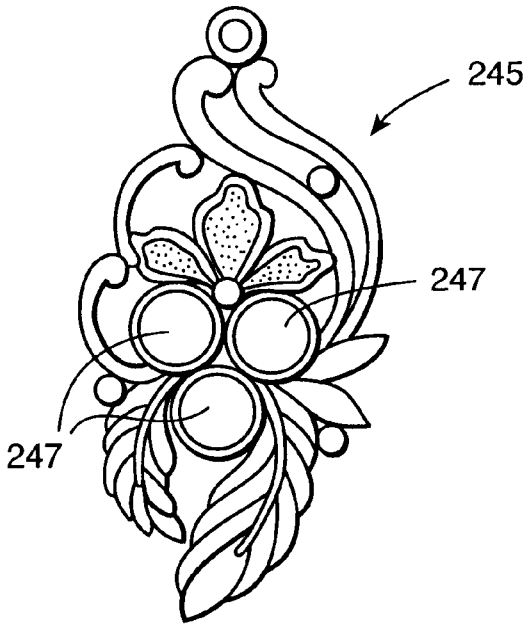
FIG. 58 shows a length of a piece of jewelry, such as a pendant, having a structural portion with a number of cylindrical pockets which can receive single non-segmented decorative jewelry items made in accordance with the present invention, such as those shown in FIGS. 48, 50, and 52.

FIG. 58 similarly shows a pendant, or broach, 245 of arbitrary design having a number of cylindrical pockets 247 formed therein to accept a single non-segmented decorative jewelry item. Alternatively, as with the bracelet of FIG. 55, the base, also numbered 247 in FIG. 58, may be integrally formed when the pendant or broach is formed.

Figure 59:
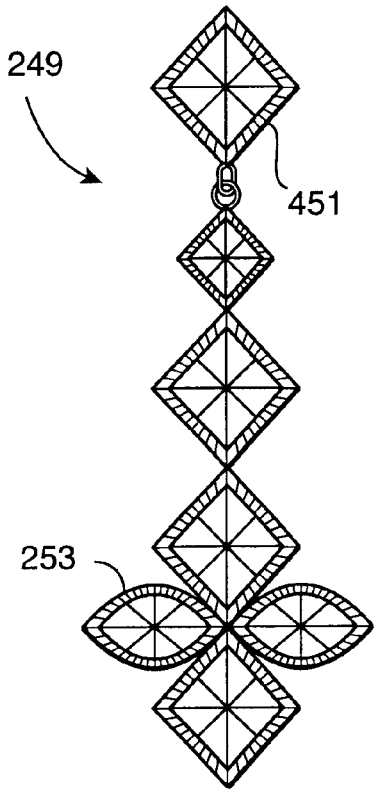
FIG. 59 shows a length of a piece of jewelry, such as an earring, having multiple pockets for receiving differently configured decorative jewelry items in each pocket in accordance with the present invention, such as geometrically altered ones of those shown in FIGS. 48, 50, and 52.

FIG. 59 shows a dangling earring 249 in which a number of rectangular and oval shaped decorative jewelry items 451, 453 are connected together in an unusual and interesting fashion.

The square-shaped or diamond-shaped decorative jewelry items 451 and each of the oval decorative jewelry items 253 are constructed in the same manner as described herein for the manufacture of a single non-segmented decorative jewelry item. The individual portions of the earring 249 may be connected by a wire, string, or coupling member, or they may be, in desired places, soldered, welded, cast together as a unit, or otherwise fixedly bonded together.

FIGS. 60–64 show a decorative jewelry item having the form of a dual base member 261 for receiving a pair of decorative inserts 275 (FIG. 62) either in a fixed position within base member 261 or loosely captured within base member 261.

The base member 261 has a hollow interior, a top 262 with a pair of heart shaped openings formed therein leading to a hollow interior. A sidewall 263 extends from the top surface 262 downwardly and has at least one opening 269 therein in each of the two segments 263, 265 of the base member 261. In the front and side perspective views shown in FIGS. 60 and 61, it will be observed that a pair of bent latch fingers 267 are attached to the bottom of the sidewall 263. In the preferred embodiment, latch fingers 267 are formed on the bottom surface of a window 264 formed at the bottom of the base member 261 in each segment 263, 265.

The base member 261 is manufactured, or prepared during assembly, such that the latch fingers 267 are bent away from the top window opening 269, as best seen in FIG. 61. This permits the insertion of a pair of decorative inserts 275 through the sidewall openings 269 and into the hollow interior of the base member 261, as best seen in FIG. 63. After full insertion of the two decorative inserts 275, the latch fingers 267 are bent upwardly to align precisely with the upper edge of the opening 269 and preferably through a cutout 266 in a support plate 271, 272 shown in FIG. 60. In this manner, the decorative insert 275 is captured within the base member 261 between the base member top 262 and the support plate 271. The upwardly bent latch fingers 267 are soldered or glued in place after the heart shaped decorative inserts 275 are installed.

The support plate 272 is shown to have a heart shaped opening therein, primarily to lessen the amount of precious metal used in the construction of the decorative jewelry item and yet provide adequate support for the heart shaped insert 275.

It will be understood that an adhesive or other type of material or molecular bonding may fix the decorative inserts 275 on the support plates 271, 272, or the decorative inserts 275 may be loosely captured between the support plate 271, 272 and top 262 of the base member 261. In such a case, the openings in the top surface 262 and the support plate 272 must necessarily be of a size smaller than the size of the decorative insert to prevent dislodging of the insert 275 inadvertently.

Figure 65:
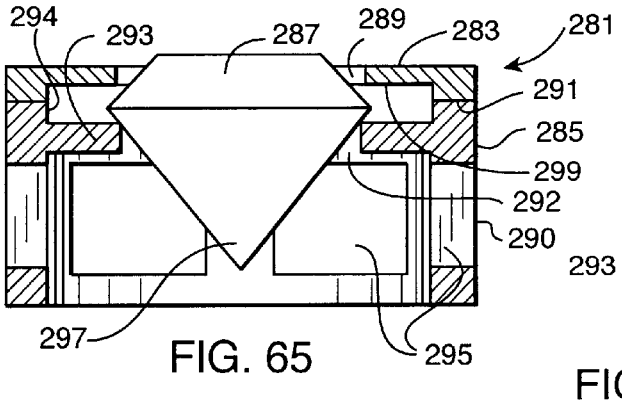
FIG. 65 is a cross sectional view of a variation of the present invention in which the decorative object is a real precious stone, or gem.

FIG. 65 is a cross sectional view of a variation of the present invention in which the jewelry item 281 comprises a real precious stone, or gem 287, as the decorative object captured between a cap 283 and a base member 285. The cap 283 can be secured to base member 285 by any of the methods described above.

The precious stone 287 shown has its widest dimension larger than both the opening 289 in cap 283 and the distance between the inwardly ends of projecting tabs 293 in base member 285. This is best seen in FIG. 66 which is a top view of just the base member 285 of the variation shown in FIG. 65, with the cap removed and with the precious stone 287 schematically represented by a dashed line.

The base member 285 has a depth sufficient to prevent the bottom 297 of the precious stone 287 from extending below the base member, thereby protecting the wearer of the jewelry item 281 from being punctured by the sharp end 297 of the stone 287.

The base member 285 has a sidewall 290 extending downwardly from the decorative top 287, 293, the sidewall 290 having a plurality of open windows 295 formed therein. The top surface opening 292 of the base member top surface 293 has an inner peripheral edge 294 and a plurality of tabs 293 projecting inwardly from the peripheral edge, the tabs 293 being of a length sufficient to prevent the precious stone 287 from falling through the top surface opening 292, whereby the precious stone 287 is supported by the tabs 293 with minimal blockage of light entering the sidewall windows 295 and illuminating the precious stone 287 from beneath.

Figure 66:
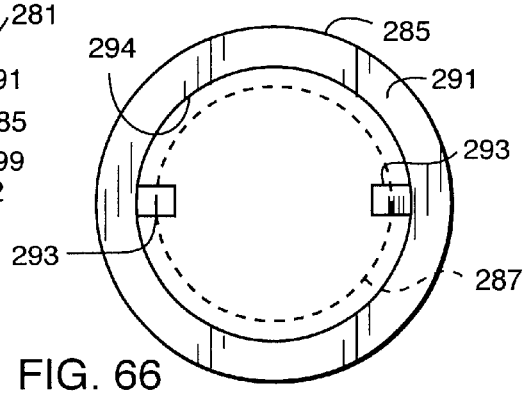
FIG. 66 is a top view of just the base member of the variation shown in FIG. 65, with the cap removed and with the precious stone, or gem, schematically represented by a dashed line.

In a preferred embodiment of FIGS. 65 and 66, the stone 287 is seen to be loosely captured between the cap 283 and base member top surface (i.e., tabs 293 in the embodiment shown).

However, it is within the skill of a craftsman to configure and dimension the cap opening 289 and length and number of tabs 293 to clamp the precious stone 287 securely between the cap 283 and base member 285, if desired.

Figure 67:
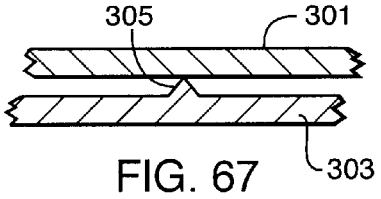
FIG. 67 is a partial cross sectional view of a first type of teetering mechanism between a decorative object and the top surface of a base member.

FIG. 67 is a partial cross sectional view of a first type of teetering mechanism between a decorative object 301 and the top surface of a base member 303. In this variation, the base member top surface 303 extends across the interior of the base member, such as that shown in FIG. 33, wherein the base member top surface 135, 303 has an upwardly projecting bump 305 positioned thereon, and the decorative object 121, 301 has a bottom which rests on the bump 305, whereby the loosely captured decorative object 301 teeters on the bump 305 functioning as a fulcrum.

Figure 68:
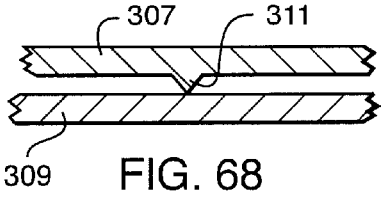
FIG. 68 is a partial cross sectional view of a second type of teetering mechanism between a decorative object and the top surface of a base member.

FIG. 68 is a partial cross sectional view of a second type of teetering mechanism between a decorative object 307 and the top surface 309 of a base member. Here, the base member top surface 309 extends across the hollow interior of the base member, and the decorative object 307 has a bottom with a downwardly projecting bump 311 positioned thereon, whereby the loosely captured decorative object 307 teeters on the bump 311 functioning as a fulcrum. The base member top surface 309 may be a plate-like member spanning the entire extent of the interior of the base member, or it may be a band or strap connected at its ends across the extent of the interior of the base member.

Figure 69:
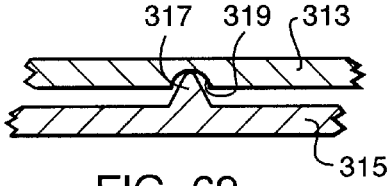
FIG. 69 is a partial cross sectional view of a third type of teetering mechanism between a decorative object and the top surface of a base member.

With reference to FIG. 69, if desired, for more security in keeping the decorative object 301 centered within the decorative jewelry item, the decorative object 313 may have a bottom with a depression 319 therein in alignment with, and sized to receive, the upwardly projecting bump 317 positioned on the base member top surface 315. In such a case, the dimensional design of the cap and base member employing the teetering mechanism of FIG. 69 will be such so as to not permit the bump 317 from exiting the depression 319.

Similarly, and consistent with the variation shown in FIG. 69, the base member top surface 309 shown in FIG. 68 may have a depression (not shown) therein in alignment with, and sized to receive; the downwardly projecting bump 311 positioned on the bottom of the decorative object 307.

Figure 70:
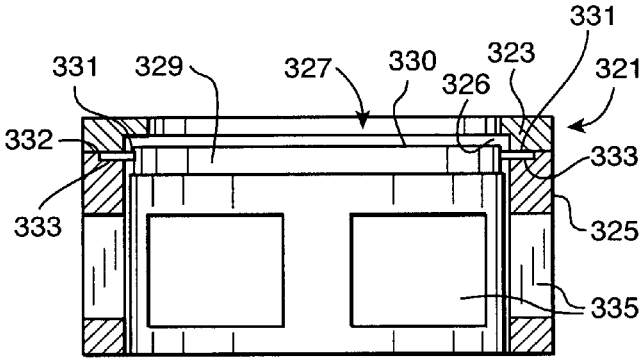
FIG. 70 is a cross sectional view of a base member with a rotatable decorative object pivotally mounted at the top of the base member between the base member and the cap.

FIG. 70 is a cross sectional view of a decorative jewelry item 321 having a cap 323 fitted to a base member 325 with a rotatable decorative object 329 pivotally mounted at the top of the base member 325 between the base member 325 and the cap 323. The decorative object 329 may have a diamond cut upper surface 330, or it may be made decorative by employing any of the surface preparation processes described herein. The cap 323 has a central opening 327 which preferably is sized smaller than the rotatable decorative object 329 so as to keep the decorative object 329 from excessive tilting and exposing an edge above the top of cap 323. Alternatively, the opening 327 may be purposely sized larger to allow the decorative object 329 to rotate as much as 360°, if desired. Similarly, the base member 325 may have a plate, or strap, or tab (not shown) fixed to the interior thereof to prevent full rotation of the decorative object 329 even when the cap opening 327 is sized larger than the decorative object 329.

Figure 71:
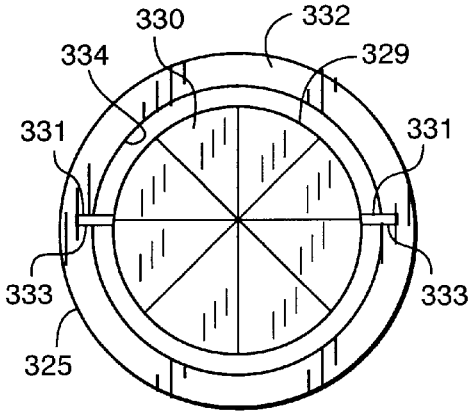
FIG. 71 is a top view of just the base member of the variation shown in FIG. 70, with the cap removed.

Referencing the cross sectional view in FIG. 70 and the top view of the base member and decorative object combination in FIG. 71 with the cap removed, the base member 325 is seen to have a hollow interior, and the decorative top 332, 329 thereof comprises: a top surface 332 with an opening 334 therein leading to the hollow interior; and the decorative object 329. The decorative object 329 is rotatably mounted in the recess 326 between the base member 325 and the cap 323 using axially aligned pins 331 resting in, and rotatable in, corresponding oppositely facing side notches 333 formed in the base member top surface 332, whereby the decorative object 329 is free to rotate within the recess 326 about an axis passing through the pins 331. The notches 333 open laterally into the base member top surface opening 334.

In this specification, where fixing or bonding is suggested, such fixing or bonding processing is intended to be selected from a number of available processes suitable for the task at hand including soldering, swaging, bending of prongs, applying of adhesive, and welding including laser welding.

Additionally, in this specification, where a decorative top, decorative object, decorative insert, or surface texturing or design are suggested, it is to be understood that such surface treatment may be selected from any of a large number of surface treatment processes, including diamond cutting, hole forming, embossing, engraving, lettering, forming line patterns, texturing, plating, coloring, etching, scoring, knurling, serrating, coating, painting, embossing, engraving, and shaping. In addition to having different surface treatments, the decorative object or insert may also be made of a different material than its base member or cap.

It is further to be understood that the number of connected modules to form a multiple-segment decorative jewelry item, and the geometrical arrangement of such connected modules, is virtually limitless. The specific arrangements shown and described herein are exemplary only.

In all embodiments and variations of the invention, the base members and caps do not necessarily have to be of the same type of material (metal) or color. For example, the base member can be silver, while the cap is yellow gold. Another example is a white gold base member with a pink gold cap. It is also within the scope of the present invention to make the base member of plastic or other hard material that is aesthetically pleasing to the eye.

While only certain embodiments of the invention have been set forth above, alternative embodiments and various modifications will be apparent from the above description and the accompanying drawing to those skilled in the art. For example, although specific examples are shown and described for convenience and ease of understanding, in variations of the invention, the base member or base member segments, the cap or cap segments, the openings in the cap or cap segments, the decorative objects, and the decorative inserts may, independently, be circular, square shaped, diamond shaped, heart shaped, and the like. Any combination of these and other geometric shapes are intended to be within the scope of the invention.

Likewise, it is contemplated that the designer may select for the base members, caps, objects, and inserts, surface features such as serrated surfaces, smooth surfaces, faceted surfaces, planar surfaces, convex surfaces, concave surfaces, conical surfaces, straight peripheral sides, stepped peripheral sides, as well as other shapes as described herein, including combinations of such features in a virtually limitless number of arrangements and presentations.

Additionally, although single and dual-segmented decorative jewelry items are shown and described in detail herein, any desired number of segments may be selected, the construction of which would be well within the skill of a person working in the jewelry art following the teaching in this description.

As described, the decorative object(s) and exposed surfaces of the stepped portion of the base units have preferred surface textures as shown and described. However, at the discretion f the designer, any or selected ones of such surfaces may be faceted, knurled, smooth, shiny, colored, frosted, or formed with diffraction gratings or filigree patterns, or may have thereon random markings, organized markings, and/or may be textured to simulate real gems.

In the preferred embodiments shown and described herein, the fastening means for fixing the cap to the base member, fixing a decorative object to the top surface of a base member, or maintaining a decorative insert within the hollow interior of a base member, may be implemented by methods such as soldering, swaging, scoring, adhesive bonding, and welding including laser welding. Swaging, scoring, and laser welding are techniques that work well with certain assembly process steps in accordance with the present invention, but are not suitable for fixing real gems in place due in large part to the configuration, shape, and weight of real gems. As to laser welding, reference is made to the apparatus and methods of laser welding techniques disclosed in California Precision Products Co. Catalog "Laser Spot-Welding Systems", One Industrial Court, Riverside, R.I. 02915, such document incorporated herein by reference.

These and other alternatives and variations are considered equivalents and within the spirit and scope of the present invention.

What is claimed is:

1. A decorative jewelry item, comprising:

a base member having a hollow interior, a peripheral sidewall surrounding said hollow interior and defining a top peripheral edge and a bottom peripheral edge, and an integrally formed decorative top closing said hollow interior along said top peripheral edge;

a cap with an opening therein, said cap having a top surface; and a cap attachment arrangement for attaching said cap to said base member with said base member decorative top positioned below said cap top surface, and with at least a portion of said decorative top being viewable through said cap opening.

2. The decorative jewelry item as claimed in claim 1, wherein said base member decorative top is fashioned to exhibit an integral decorative exterior surface which is viewable through said cap opening.

3. The decorative jewelry item as claimed in claim 1, wherein said cap is fixed to said base member by a process selected from the group consisting of soldering, swaging, bending of prongs, applying of adhesive, and welding including laser welding.

4. The decorative jewelry item as claimed in claim 1, wherein said cap top surface exhibits an integral decorative exterior surface.

5. The decorative jewelry item as claimed in claim 1, wherein:

said base member has a sidewall extending downwardly from said decorative top, said sidewall having at least one cutout therein; and said cap attachment arrangement comprises at least one prong depending downwardly from said cap, said prong adapted to be bent into said cutout when said cap is placed over said decorative top.

6. The decorative jewelry item as claimed in claim 5, wherein:

said sidewall of said base member has at least one window opening to the interior of said hollow base member, said window having a top; and said at least one cutout is formed at the top of said at least one window.

7. The decorative jewelry item as claimed in claim 6, wherein:

said base member sidewall has a plurality of windows formed therein and cutouts formed in selected ones of said windows; and said cap comprises a plurality of prongs adapted to be bent into respective cutouts when said cap is placed over said decorative top.

8. The decorative jewelry item as claimed in claim 7, wherein the number of windows is greater than the number of prongs and cutouts.

9. The decorative jewelry item as claimed in claim 5, wherein said base member sidewall is made decorative by performing at least one of a number of surface preparation processes on at least a portion of said sidewall, said surface preparation processes including diamond cutting, hole forming, embossing, engraving, lettering, forming line patterns, texturing, plating, coloring, etching, scoring, knurling, serrating, coating, painting, embossing, engraving, and shaping.

10. The decorative jewelry item as claimed in claim 1, formed integrally with a like decorative jewelry item in a manner to align said decorative tops generally in a common plane, thereby forming a dual decorative jewelry item, wherein:

said base members have a common sidewall extending downwardly from said decorative tops, said sidewall having at least one window formed therein leading to the interior of said hollow base member; and said sidewall comprises a connector element for connecting said dual decorative jewelry item to a like dual decorative jewelry item by bending said connector element of one dual decorative jewelry item after passing through a sidewall window in an adjacent dual decorative jewelry item.

11. The decorative jewelry item as claimed in claim 1, wherein said base member has a sidewall extending downwardly from said decorative top; and said cap attachment arrangement is implemented by the provision on said cap of a downwardly directed peripheral wall, said cap wall covering a relatively small top portion of said base member sidewall when said cap is placed over said decorative top.

12. The decorative jewelry item as claimed in claim 11, wherein said cap is fixed to said base member, after being placed over said decorative top, by a process selected from the group consisting of soldering, swaging, bending of prongs, applying of adhesive, and welding including laser welding.

13. The decorative jewelry item as claimed in claim 1, wherein:

said base member has a sidewall extending downwardly from said decorative top and encompassing the interior of said hollow base member;

said base member decorative top has at least one hole therein leading downwardly into the interior of said hollow base member; and said cap attachment arrangement comprises at least one prong depending downwardly from said cap, said prong adapted to be passed through said at least one hole in said decorative top and bent over within the interior of said hollow base member when said cap is placed over said decorative top.

14. The decorative jewelry item as claimed in claim 13, wherein:

said base member decorative top has a plurality of holes formed therein; and said cap comprises a plurality of prongs adapted to pass through respective in number to the number of holes in said decorative top.

15. The decorative jewelry item as claimed in claim 13, wherein said holes in said decorative top, and said prongs, are rectangular in cross section.

16. The decorative jewelry item as claimed in claim 1, wherein said base member top is made decorative by performing at least one of a number of surface preparation processes on at least a portion of said base member top, said surface preparation processes including diamond cutting, hole forming, embossing, engraving, lettering, forming line patterns, texturing, plating, coloring, etching, scoring, knurling, serrating, coating, painting, embossing, engraving, and shaping.

17. The decorative jewelry item as claimed in claim 1, wherein:

said cap has a top surface; and said cap top surface is made decorative by performing at least one of a number of surface preparation processes on at least a portion of said cap top surface, said surface preparation processes including diamond cutting, hole forming, embossing, engraving, lettering, forming line patterns, texturing, plating, coloring, etching, scoring, knurling, serrating, coating, painting, embossing, engraving, and shaping.

18. The decorative jewelry item as claimed in claim 1, wherein:

said cap has a peripheral edge; and said cap edge is made decorative by performing at least one of a number of surface preparation processes on at least a portion of said cap edge, said surface preparation processes including diamond cutting, hole forming, embossing, engraving, lettering, forming line patterns, texturing, plating, coloring, etching, scoring, knurling, serrating, coating, painting, embossing, engraving, and shaping.

19. The decorative jewelry item as claimed in claim 1, wherein:

said base member comprises a linking arrangement for linking said decorative jewelry item to a like decorative jewelry item.

20. The decorative jewelry item as claimed in claim 1, wherein:

said base member has a stepped top outside peripheral surface comprising a vertical wall portion and a horizontal step portion.

21. The decorative jewelry item as claimed in claim 20, wherein:

said horizontal step portion has an irregular exposed surface.

22. The decorative jewelry item as claimed in claim 1, wherein:

said cap has a planar top surface.

23. The decorative jewelry item as claimed in claim 1, wherein:

said cap has a generally conical top surface.

24. The decorative jewelry item as claimed in claim 1, wherein:

said base member is segmented, defining a plurality of base member segments each having a decorative top, fixedly connected together side-by-side;

said cap is segmented, defining a like plurality of cap segments each having an opening therein, fixedly connected together side-by-side; and said cap attachment arrangement is adapted to attach said segmented cap to said segmented base member with at least a portion of each said decorative top being viewable through said cap openings.

25. The decorative jewelry item as claimed in claim 24, wherein:

said base member segments are substantially identical to one another in geometrical shape; and said cap segments are of the same geometrical shape as the corresponding ones of said base member segments.

26. The decorative jewelry item as claimed in claim 24, wherein:

said base member segments are substantially identical to one another in geometrical shape; and at least one of said cap segments is of a geometrical shape different than that or its corresponding base member segment.

27. The decorative jewelry item as claimed in claim 26, wherein:

each of said base member segments is circular in horizontal cross section;

each of said decorative tops has a diamond cut exposed surface;

one of said cap segments has a circular outer periphery and a circular opening therein; and another of said cap segments has a circular outer periphery and a heart shaped opening therein.

28. The decorative jewelry item as claimed in claim 24, wherein:

said decorative tops of said plurality of base member segments are not alike, each said decorative top having its own characteristic shape, design, and visual appearance.

29. The decorative jewelry item as claimed in claim 24, wherein:

said cap segments are not alike, each said cap having a top surface exhibiting its own characteristic shape, design, and visual appearance.

30. The decorative jewelry item as claimed in claim 24, wherein:

said cap segments are not alike, each said cap having a peripheral side surface exhibiting its own characteristic shape, design, and visual appearance.

31. The decorative jewelry item as claimed in claim 24, wherein:

said cap segments are not alike, each said cap having an opening with its own shape, design, and visual appearance.

32. The decorative jewelry item as claimed in claim 31, wherein each of said cap openings has a shape and configuration selected from the group consisting of circular, square, heart-shaped, cross-shaped, scalloped, star-shaped, serrated, knurled, undulated, rippled, clover leaf shaped, triangular, and polygonal.

33. The decorative jewelry item as claimed in claim 32, wherein at least one of said caps has a filagree-like ornamentation extending into its opening.

34. The decorative jewelry item as claimed in claim 24, wherein:

each said cap has an inner periphery, a connected outer periphery, and a relatively narrow width between said outer and inner peripheries, such that a portion of each said decorative top is exposed outside said cap outer periphery.

35. The decorative jewelry item as claimed in claim 34, wherein:

a portion of each said decorative top that is exposed through a respective cap opening has a different visual appearance than a portion of said decorative top exposed outside said cap outer periphery.

36. The decorative jewelry item as claimed in claim 35, wherein:

each said decorative top portion exposed through said cap opening has a diamond cut surface; and each said decorative top portion exposed outside said cap outer periphery has a surface finish selected from the group consisting of faceted, knurled, smooth, shiny, colored, frosted, formed with diffraction gratings, formed with applied filigree patterns, random markings, organized markings, and textured.

37. The decorative jewelry item as claimed in claim 35, wherein said connected outer periphery of said cap has a surface finish selected from the group consisting of faceted, knurled, smooth, shiny, colored, frosted, formed with diffraction gratings, formed with applied filigree patterns, random markings, organized markings, and textured.

38. The decorative jewelry item as claimed in claim 1, wherein:

said base member has a sidewall extending downwardly from said decorative top, said sidewall having at least one window opening therein; and said cap attachment arrangement comprises at least one prong depending downwardly from said cap, said prong adapted to be bent into said window opening when said cap is placed over said decorative top.

39. The decorative jewelry item as claimed in claim 38, wherein:

said sidewall of said base member has at least one channel formed therein, leading from said decorative top to said window opening; and said at least one prong extends from a bottom surface of said cap, is contained within said channel, and is bent over inwardly of said base member through said window opening, when said cap is placed over said decorative top.

40. The decorative jewelry item as claimed in claim 39, wherein said decorative top and said cap have identical outer peripheral surfaces.

41. The decorative jewelry item as claimed in claim 39, wherein:

said base member sidewall has a plurality of windows formed therein and a plurality of channels leading from said decorative top to selected ones of said windows;

said cap comprises a plurality of prongs equal in number to the number of channels in said sidewall; and the number of windows is at least as great as the number of prongs and channels.

42. The decorative jewelry item as claimed in claim 1, wherein:

said hollow base member is made from a first material of a first color; and said cap is made from a second material of a different color.

43. The decorative jewelry item as claimed in claim 1, wherein said cap has a top surface configuration selected from the group of surface configurations consisting of planar, concave, convex, conical, concave-conical, and convex-conical.

44. The decorative jewelry item as claimed in claim 1, wherein:

said cap has an outer periphery, an inner periphery, and a relatively narrow width between said outer and inner peripheries, such that a portion of said decorative top is exposed outside said cap outer periphery.

45. The decorative jewelry item as claimed in claim 44, wherein:

a portion of said decorative top exposed through said cap opening has a different visual appearance than a portion of said decorative top exposed outside said cap outer periphery.

46. The decorative jewelry item as claimed in claim 45, wherein:

said decorative top portion exposed through said cap opening has a diamond cut surface; and said decorative top portion exposed outside said cap outer periphery has a surface finish selected from the group consisting of faceted, knurled, smooth, shiny, colored, frosted, formed with diffraction gratings, formed with applied filigree patterns, random markings, organized markings, and textured.

47. The decorative jewelry item as claimed in claim 45, wherein said cap outer periphery has a surface finish selected from the group consisting of faceted, knurled, smooth, shiny, colored, frosted, formed with diffraction gratings, formed with applied filigree patterns, random markings, organized markings, and textured.

48. The decorative jewelry item as claimed in claim 1, wherein:

said cap has a stepped top outside peripheral surface comprising a vertical wall portion and a horizontal step portion.

49. A piece of jewelry with a designed structure including at least one recess for receiving the decorative jewelry item as claimed in claim 1.

50. The piece of jewelry as claimed in claim 49, wherein said recess and said decorative top are circular.

51. The piece of jewelry as claimed in claim 49, wherein said recess and said decorative top are heart shaped.

52. The piece of jewelry as claimed in claim 49 manufactured as a decorative jewelry piece selected from the group consisting of a necklace, a bracelet, a ring, a pendant, a broach, and an earring.

53. The decorative jewelry item as claimed in claim 1, wherein: said base member has at least one through hole formed in said decorative top at a location which is covered by said cap and hidden from view.

54. A piece of jewelry with a designed structure, comprising:

an integrally formed decorative portion having a hollow interior, a peripheral sidewall surrounding said hollow interior and defining a top peripheral edge and a bottom peripheral edge, and an integrally formed decorative top closing said hollow interior along said top peripheral edge;

a cap with an opening therein, said cap having a top surface; and a cap attachment arrangement for attaching said cap to said decorative portion of said piece of jewelry with said decorative top positioned below said cap top surface, and with at least a portion of said decorative top being viewable through said cap opening.

55. The piece of jewelry as claimed in claim 54 wherein said decorative top is fashioned to exhibit an integral decorative exterior surface which is viewable through said cap opening.

56. The piece of jewelry as claimed in claim 54 manufactured as a decorative jewelry piece selected from the group consisting of a necklace, a bracelet, a ring, a pendant, a broach, and an earring.

57. A decorative jewelry item, comprising:

a base member having a hollow interior, a top with an opening therein leading to said hollow interior, a bottom, and a sidewall extending from said top to said bottom, said sidewall having an opening therein leading to said hollow interior;

a decorative insert configured and sized in relation to said base member to be inserted within said hollow interior through said sidewall opening and viewable through said top opening; and a retainer for retaining said decorative insert within said base member hollow interior.

58. The decorative jewelry item as claimed in claim 57, comprising:

a support member fixed to said base member within said hollow interior; and wherein said decorative insert is captured within said base member between said base member top and said support member.

59. The decorative jewelry item as claimed in claim 58, wherein said decorative insert is fixed to said support member within said base member.

60. The decorative jewelry item as claimed in claim 58, wherein said decorative insert is loosely captured between said base member top and said support member.

61. The decorative jewelry item as claimed in claim 57, wherein:

said base member comprises a tab bendable to a first position in which said sidewall opening is not blocked, and bendable to a second position in which said sidewall opening is blocked, whereby said tab is in said first position to permit placement of said insert within said base member through said sidewall opening, and said tab is bent to said second position after said insert is contained within said base member interior.

62. A decorative jewelry item, comprising:

a base member having a hollow interior, a peripheral sidewall surrounding said hollow interior and defining a top peripheral edge and a bottom peripheral edge, and an integrally formed top surface closing said hollow interior along said top peripheral edge, said base member top surface having an opening therein leading to said hollow interior;

a decorative object placed on said base member top surface, and said decorative object comprising a precious stone;

a cap with an opening therein, said cap having a top surface; and a cap attachment arrangement for attaching said cap to said base member, said decorative object configured and sized in relation to said base member and said cap to be placed partially within said top surface opening while being prevented from falling through said top surface opening by said top surface and to extend below said cap top surface, with at least a portion of said decorative object being viewable through said cap opening, said cap attachment arrangement fixing said cap to said base member whereby said precious stone is free to move while being loosely captured between said base member and said cap.

63. The decorative jewelry item as claimed in claim 62, wherein said base member has sufficient to prevent the bottom of said precious stone from extending below said base member.

64. The decorative jewelry item as claimed in claim 63, wherein:

said base member has a sidewall extending downwardly from said decorative top, said sidewall having a plurality of open windows formed therein; and said top surface opening has an inner peripheral edge and a plurality of tabs projecting inwardly from said peripheral edge, said tabs being of a length sufficient to prevent said precious stone from falling through said top surface opening;

whereby said precious stone is supported by said tabs with minimal blockage of light entering said sidewall windows and illuminating said precious stone from beneath.

65. A decorative jewelry item, comprising:

a base member having a hollow interior, a peripheral sidewall surrounding said hollow interior and defining a top peripheral edge and a bottom peripheral edge, and an integrally formed top surface closing said hollow interior along said top peripheral edge;

a decorative object placed on said base member top surface;

a cap with an opening therein, said cap having a top surface; and a cap attachment arrangement for attaching said cap to said base member, said decorative object configured and sized in relation to said base member and said cap to be positioned completely below said cap top surface, with at least a portion of said decorative object being viewable through said cap opening.

66. The decorative jewelry item as claimed in claim 65, wherein:

said decorative object is plate-shaped and has an upper decorative surface.

67. The decorative jewelry item as claimed in claim 65, comprising a plurality of said decorative objects, and wherein:

said base member is of unitary construction and divided into component parts, defining a plurality of side-by-side connected base member segments;

each of said plurality of side-by-side connected base member segments supports an independent one of said decorative objects, thereby defining a plurality of independent decorative objects;

said cap is of unitary construction and divided into component parts, defining a plurality of side-by-side connected cap segments, each said cap segment having an independent opening therein; and said cap attachment arrangement is adapted to attach said cap to said base member with at least a portion of each said decorative object being viewable through respective cap openings.

68. The decorative jewelry item as claimed in claim 67, wherein:

at least one of said base member top surface and said cap has a recess therein; and said cap attachment arrangement fixes said cap to said base member, whereby one of said decorative objects is loosely captured between said base member and said cap and is free to move within said recess.

69. The decorative jewelry item as claimed in claim 68, wherein:

said base member top surface has an upwardly projecting bump positioned thereon; and said decorative object has a bottom which rests on said bump, whereby said loosely captured decorative object teeters on said bump functioning as a fulcrum.

70. The decorative jewelry item as claimed in claim 69, wherein said decorative object bottom has a depression therein in alignment with, and sized to receive, said upwardly projecting bump positioned on said base member top surface.

71. The decorative jewelry item as claimed in claim 68, wherein:

said decorative object has a bottom with a downwardly projecting bump positioned thereon, whereby said loosely captured decorative object teeters on said bump functioning as a fulcrum.

72. The decorative jewelry item as claimed in claim 71, wherein said base member surface has a depression therein in alignment with, and sized to receive, said downwardly projecting bump positioned on said decorative object bottom.

73. The decorative jewelry item as claimed in claim 68, wherein:

said decorative object is rotatably mounted in said recess between said base member and said cap using axially aligned pins resting in, and rotatable in, corresponding notches.

74. The decorative jewelry item as claimed in claim 73, wherein:

said base member has a hollow interior;

said base member top surface has an opening therethrough to said hollow interior, and a pair of oppositely facing side notches formed in said base member top surface, said notches opening laterally into said base member top surface opening;

said decorative object is sized smaller than said base member top surface opening; and said decorative object has a pair of oppositely located outwardly extending side pins fitting into, and rotatable in, respective ones of said side notches; whereby said decorative object is free to rotate within said recess about an axis passing through said pins.

75. The decorative jewelry item as claimed in claim 67, wherein said independent decorative objects have different visual appearances.

76. The decorative jewelry item as claimed in claim 75, wherein said independent decorative objects have different shapes selected from the group consisting of circular, square, heart-shaped, cross-shaped, scalloped, star-shaped, undulated, rippled, clover leaf shaped, triangular, and polygonal.

77. The decorative jewelry item claimed in claim 65, wherein:

at least one of said base member top surface and said cap has a recess therein; and said cap attachment arrangement fixes said cap to said base member, whereby said decorative object is loosely captured between said base member and said cap and is free to move within said recess.

78. The decorative jewelry item as claimed in claim 77, wherein:

said base member top surface is substantially planar; and said cap has a cupped bottom to accommodate said decorative object loosely between said cap and said base member top surface.

79. A decorative jewelry item, comprising:

a hollow base member having an integrally formed raised decorative top portion;

a cap with an opening therein, said cap having a top surface; and a cap attachment arrangement consisting of a base member portion defined on said hollow base member and a cap portion defined on said cap, for attaching said cap to said base member with at least a part of said base member raised decorative top portion protruding into said cap opening.

80. The decorative jewelry item as claimed in claim 79, wherein said raised decorative portion protrudes through said cap opening to a position above said cap.

81. A decorative jewelry item, comprising:

a base member having a hollow interior, a peripheral sidewall surrounding said hollow interior and defining a top peripheral edge and a bottom peripheral edge, and an integrally formed planar top surface closing said hollow interior along said top peripheral edge;

a decorative object placed on said base member top surface;

a cap with an opening therein, said cap having a top surface; and a cap attachment arrangement for attaching said cap to said base member, said decorative object configured and sized in relation to said base member and said cap such that a portion of said decorative object protrudes through said cap opening.

82. The decorative jewelry item as claimed in claim 81, wherein said decorative object extends above said cap top surface.

* * * * *